US005784042A

United States Patent [19]

Ono et al.

[11] Patent Number: 5,784,042

[45] Date of Patent: Jul. 21, 1998

[54] LIQUID CRYSTAL DISPLAY DEVICE AND METHOD FOR DRIVING THE SAME

[75] Inventors: Kikuo Ono, Naka-machi; Nobutake Konishi, Hitachiota, both of Japan

[73] Assignee: Hitachi, Ltd., Tokyo, Japan

[21] Appl. No.: 369,266

[22] Filed: Jan. 5, 1995

Related U.S. Application Data

[63] Continuation of Ser. No. 852,664, Mar. 17, 1992, abandoned.

[30] Foreign Application Priority Data

Mar. 19, 1991 [JP] Japan ..... 3-054344

[51] Int. Cl.[6] ..... G09G 3/36

[52] U.S. Cl. ..... 345/94; 345/95; 345/92; 345/208

[58] Field of Search ..... 345/94, 95, 96, 345/97, 53, 92, 208, 209, 210, 87; 359/55, 59, 56; 349/42, 43, 48

[56] References Cited

U.S. PATENT DOCUMENTS

| | | | |
|---|---|---|---|
| 4,909,602 | 3/1990 | Kaneko et al. | 340/784 |
| 4,955,697 | 9/1990 | Tsukada et al. | 340/784 |
| 5,034,735 | 7/1991 | Inoue et al. | 340/784 |
| 5,182,549 | 1/1993 | Taniguchi et al. | 345/97 |
| 5,252,954 | 10/1993 | Nagata et al. | 345/95 |

FOREIGN PATENT DOCUMENTS

| | | | |
|---|---|---|---|
| 2262121 | of 0000 | Japan . | |
| 6468724 | of 0000 | Japan . | |
| 01219827 | 9/1989 | Japan | 345/94 |

*Primary Examiner*—Richard Hjerpe
*Assistant Examiner*—Lun-Yi Lao
*Attorney, Agent, or Firm*—Antonelli, Terry, Stout & Kraus, LLP

[57] ABSTRACT

An active matrix liquid crystal display device having a redundancy structure implemented by forming loops of drain lines by connecting two or more abutted drain lines, and providing sampling transistors on both sides of the display panel thereof or the like, so as to be able to deal with short circuits in drain lines and defects in driving TFTs occurring during manufacture, thereby providing an improved quality of display which will not deteriorate even if defects occur, thus preventing the loss of function in a display device. The drive signals for the sampling transistors which control signals to be applied to respective drain lines in a drive circuit for driving liquid crystal elements are reversed in polarity for every frame in order to suppress the occurrence of flicker or the like in the display screen so as to attain a clean, clear and high-quality screen display.

15 Claims, 14 Drawing Sheets

LIQUID CRYSTAL DISPLAY DEVICE AND METHOD FOR DRIVING THE SAME

CROSS-REFERENCE TO RELATED APPLICATION

This is a continuation of application Ser. No. 07/852,664 filed on Mar. 17, 1992, now abandoned.

BACKGROUND OF THE INVENTION

The present invention relates to a liquid crystal display device, and in particular, it relates to a liquid crystal display device constituted by an active matrix structure utilizing, for example, thin film transistors (TFTs), and to a driving method suitable for driving the same to provide a multilevel gradation display.

A known liquid crystal display having a TFT active matrix structure has been described, for example, in Japan Electronics, Information and Communication Society Transactions, Vol. J72-C-11, pp. 943–951, October 1989, where the known liquid crystal display has part of its built-in drive circuit disposed on a transparent substrate. Further, in contrast to conventional driving methods whereby scanning voltages for supplying video signals are reversed in polarity from frame to frame, the gate voltages of the drive circuit thereof are not reversed between plus and minus from frame to frame. Further, another known liquid crystal display having a TFT active matrix structure has been described in Japan Patent Publication No. 1-68724 (originally No. 64-68724), which aims at solving a problem of discontinuity in drain lines (by providing a redundancy structure in order to prevent deterioration in display quality), characterized in that a pair of TFTs provided for a single picture element or pixel (liquid crystal capacitance) disposed opposite each other on the left and the right sides thereof, each connected to a pair of drain lines running in a loop ensures, even when a part of one of the drain lines is broken or interrupted, transmission of signals to the pixel via at least one of the pair of the drain lines.

Further, with respect to the multilevel displays, there have been disclosed various driving methods for multicolor displays of 16 colors or more as shown, for example, in Flat Panel Display edited by Nikkei BP KK, pp. 173–180, November issue, 1991, in which the frame rate control method (hereinafter abbreviated as FRC), one of the methods suitable for displaying a multilevel gradation display, is described.

TFT liquid crystal display devices have been employed, as small-sized and low power consumption display units, for use as monitors and the like for microcomputers. Active matrix liquid crystal display devices which exhibit excellent quality of display, when used in such applications, have a problem in that in comparison with CRTs (or cold cathode tubes), the cost of components, in particular, that of driver ICs for driving TFTs (pixel TFTs) which energize the pixels, is substantially higher. In an attempt to solve such a problem, it has been tried to form or build a part or full function of the driver ICs concurrently with the formation of picture element TFTs on a same transparent substrate to reduce the number of driver ICs. For example, by providing a pair of abutted and juxtaposed drain lines as a video signal drain line, and dividing an incoming video signal voltage between sampling TFTs, the number of drain lines for connection, that is, the number of driver ICs on the video signal side, can be halved. In the operation of this type of device, however, there is a problem that because an overlap time between an on-voltage of a gate voltage and a drain voltage is halved, there occurs a difference in charging capability for each pixel which can result in insufficient charging for some pixels, thereby causing a nonuniform or defective display.

Further, although there will be no problems in such a case where TFTs constituting a built-in circuit mounted on a same transparent substrate have almost the same driving capability as that of an integrated circuit formed on a silicon substrate, in practice, however, the mobility in TFTs formed on the transparent substrate, indicative of the driving capability thereof, is low, thereby causing a problem that the display quality of liquid crystal display devices utilizing the FRC (frame rate control) driving method and the active matrix method having built-in peripheral drive circuits becomes deteriorated.

SUMMARY OF THE INVENTION

Therefore, a first object of the present invention is to provide a liquid crystal display device of the active matrix kind with the peripheral circuits thereof built in the same substrate, whereby degraded or defective switching properties (due to increased conduction resistance or reduced interruption resistance) of the sampling TFTs, reduction in the manufacturing yield due to discontinuities in the drain lines and lowering of the intensity are minimized. Further, a second object of the invention is to provide a driving method for solving the problem of the aforementioned insufficient charging for some pixels, and achieving a high quality display through the use of an appropriate driving method capable of providing a uniform display free from flickers, flaws or blemishes, in combination with the FRC driving method.

The first object of the invention is capable of being accomplished by providing a loop circuit formed by connecting abutted and juxtaposed drain lines for driving picture elements or pixels arrayed in columns, and concurrently by arranging at least three or more switching elements for controlling the opening and closing of the loop disposed opposingly on both sides of the display screen outside the effective display area, or by disposing a switching element on one end thereof and an output terminal on the other end In case of the failure of a sampling transistor, a switching element provided on the other end thereof may be utilized for sampling, or a switching element for sampling may be connected to the output terminal provided likewise on the other end such as to be operable in a redundant manner to deal with the failure of transistors. Further, with respect to discontinuities in the drain lines, by connecting the abutted drain lines to form a loop circuit, video signals are ensured to be transmitted to pertinent pixels even when part of one of the drain lines is broken or interrupted, thereby preventing degradation in the display quality due to drain line defects.

Further, the second object of the invention is capable of being accomplished by providing a drive method in which a center value of the drain voltages of the built-in circuit TFTs is set as a reference voltage, and an overlap time between a drain voltage VD to be applied to a pixel which is higher than the reference voltage and a gate voltage pulse which turns a pixel TFT on is set to be longer than an overlap time between a drain voltage VD to be applied to the pixel which is lower than the reference voltage and the gate voltage pulse which turns the pixel TFT on, or through the use of an FRC drive method in combination with the preceding method.

DESCRIPTION OF THE PREFERRED EMBODIMENTS

Preferred embodiments of the invention will now be described with reference to the accompanying drawings.

Figure 1:
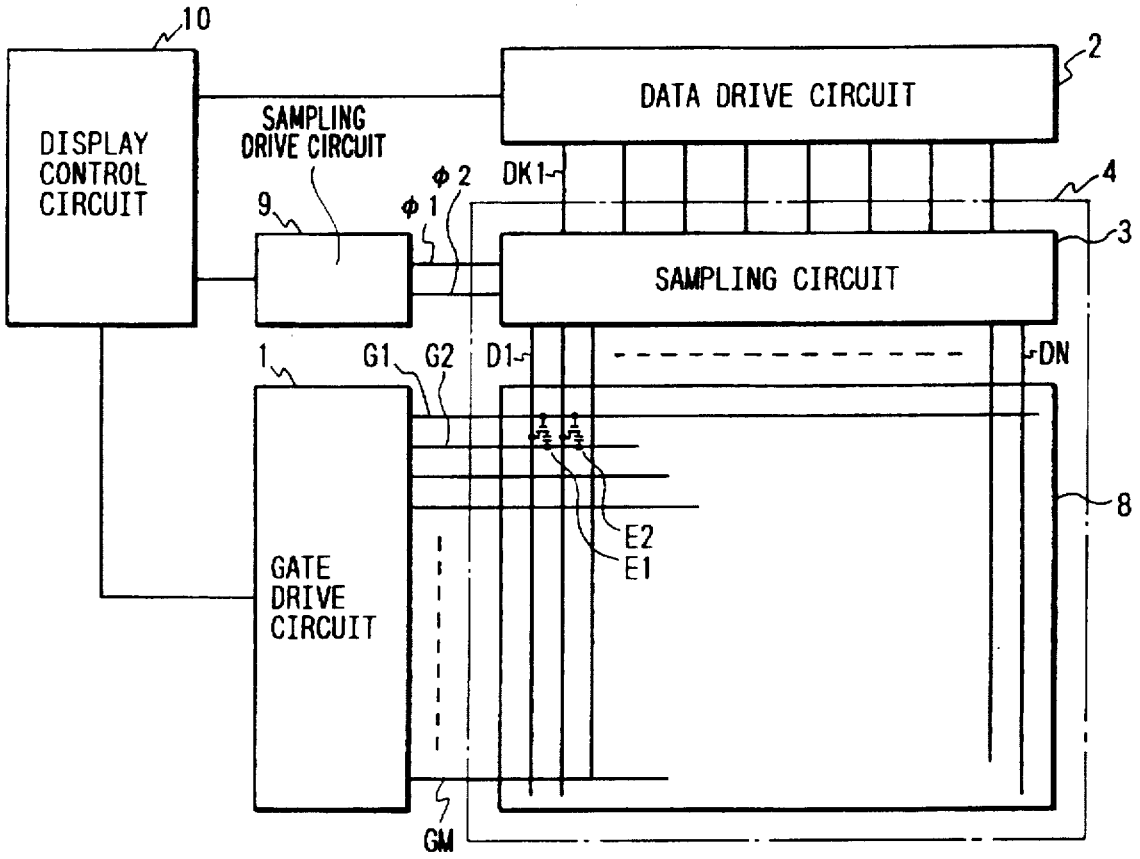
FIG. 1 is a schematic block diagram showing an overall configuration of a liquid crystal display device in an embodiment of the invention.

FIG. 1 shows a preferred embodiment of an active matrix liquid crystal display device according to the present invention.

A liquid crystal display area 8 in FIG. 1 comprises a plurality of liquid crystal cells arranged in rows and columns of a matrix, each one of the cells being provided with a pixel TFT through the switching operation of which each cell is effected to be driven. Gate (address) lines Gl through GM each connecting respective gate electrodes of TFTs arranged in a row are supplied with gate-on voltages from a gate drive circuit 1 to turn on the gates of TFTs for every gate line sequentially in turn.

On the other hand, drain lines D1 through DN each connecting respective drain electrodes of TFTs arranged in a column are supplied with data voltages from a data drive circuit 2 through a sampling circuit 3 sequentially in turn for every gate line which was applied with the foregoing gate-on voltage, thereby charging respective liquid crystal cells in that order. Further, the sampling circuit 3 is provided with sampling TFTs each provided in accordance with the foregoing drain lines, and gate terminals connecting the gate electrodes of the sampling TFTs are supplied with a plurality of sampling voltages θ1, θ2 while the gate-on voltages are being applied to the pixel TFTs. Although these sampling voltages θ1 and θ2 are supplied from a sampling drive circuit 9, they are controlled by a display control circuit 10 (which also outputs control signals to the gate drive circuit 1 and the data drive circuit 2) which determines an appropriate frame and instructs the sampling drive circuit 9 (which may be incorporated into the display control circuit 10 in this embodiment of the invention) to reverse the polarity of the sampling voltages for every frame. Further, since the drain voltages to be inputted to the sampling circuit 3 can be grouped according to the number of sampling voltages, the number of drain lines between the sampling circuit 3 and the data drive circuit 2 can be reduced substantially.

Figure 2:
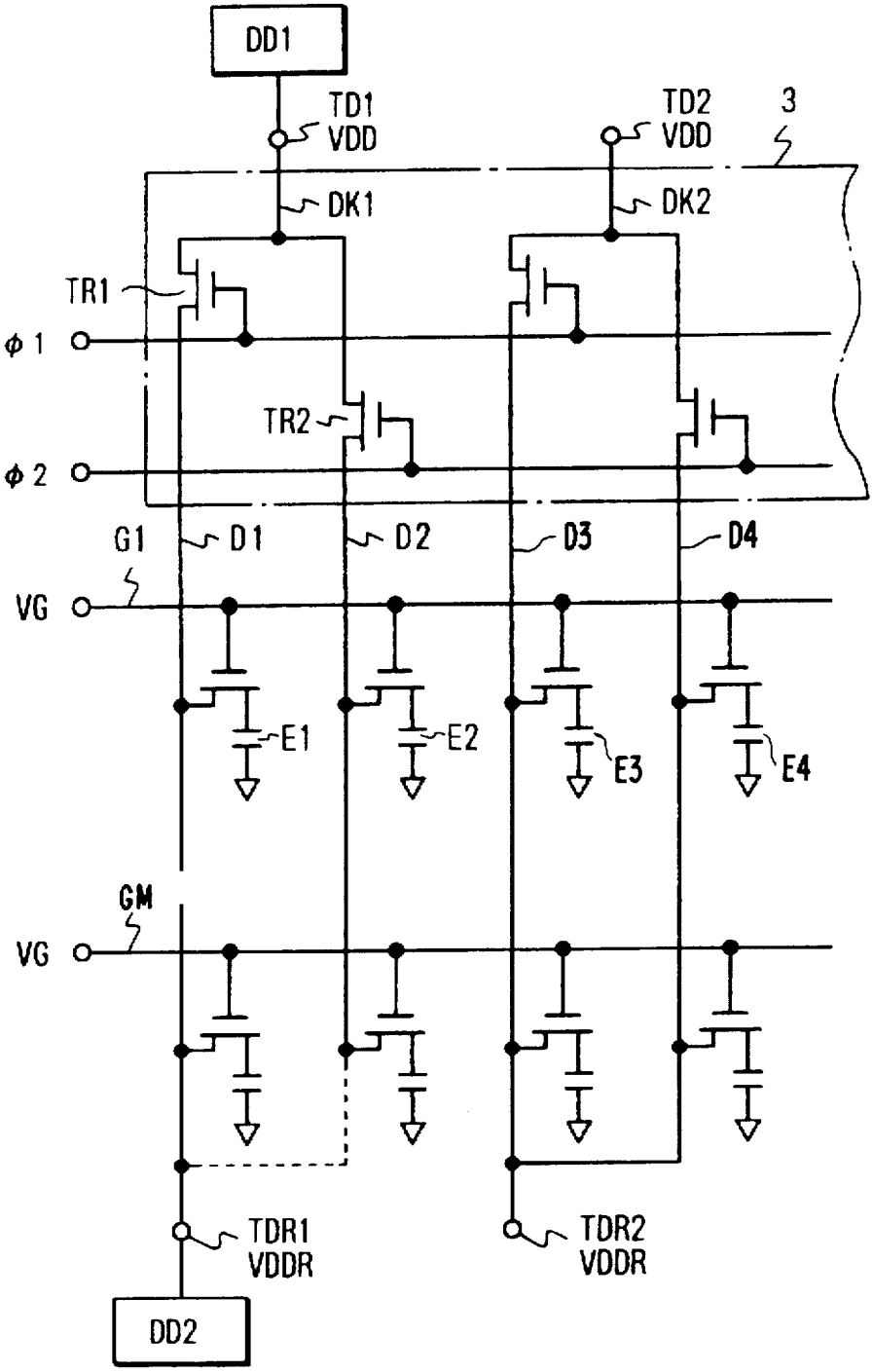
FIG. 2 shows an equivalent circuit of the embodiment of FIG. 1.

If at least the sampling circuit 3 among the foregoing peripheral circuits is formed on a substrate 4 made of glass or a like material concurrently with the pixel TFTs, with the number of connections between the sampling circuit 3 and the data drive circuit 2 being reduced according to the number of sampling voltages to be applied to the sampling TFTs, the number of connections between a display device itself formed on the glass substrate 4 and an externally provided data drive circuit 2 will be reduced, thereby substantially simplifying the structure of the data drive circuit 2. In the case shown in FIG. 2 where the number of sampling voltages is two, drain lines D1 and D2 are connected together through sampling transistors TR1 and TR2 to a line DK1 which is connected to a driver IC DD1 through a terminal TD1, as a result of which the number of connections between the substrate on which are formed the pixel TFTs and the sampling circuit 3 and the data drive circuit 2 is halved, such that the number of driver ICs constituting the data drive circuit 2 can be halved. Because the sampling circuit 3 can be fabricated readily through the same process of manufacture as that of the pixel TFTs, the production cost of the liquid crystal display device can be reduced substantially and beneficially according to the reduced number of driver ICs. Further, in FIG. 2, there is provided a back-up or fail-safe terminal TDR1 on the opposite side of the sampling transistors TR1 and TR2. Such an arrangement permits, in case of a failure of sampling transistors discovered through inspection of the characteristics thereof prior to mounting of driver ICs in the manufacturing process, for both terminals not only on the side of the sampling transistors but also on the backup side to be connected to respective driver ICs (DD1 and DD2).

For example, let us consider a failure where the switching characteristics of the sampling transistors are deteriorated due to an increased conduction resistance and/or a decreased cut-off resistance.

Assume that sampling voltage θ1 is held at a high level and sampling voltage θ2 is held at a low level, with TR1 being turned on and TR2 being turned off. Under such conditions, a voltage associated with pixel El is applied to terminals TD1 and TDR1 from driver ICs DD1 and DD2. With respect to drain line D1 in direct contact with driver IC DD2 having a low resistance, the drain line D1 is ensured to be supplied with a predetermined voltage from driver IC DD2 even when the conduction resistance of TR1 is increased slightly and/or the cut-off resistance of TR2 is decreased slightly, thus freeing driver IC DD1 from adverse effects due to undervoltage in the supply voltage. Through such an arrangement to deal with and solve failures in sampling transistors, a significant increase in the manufacturing cost can be prevented.

Figure 3A:
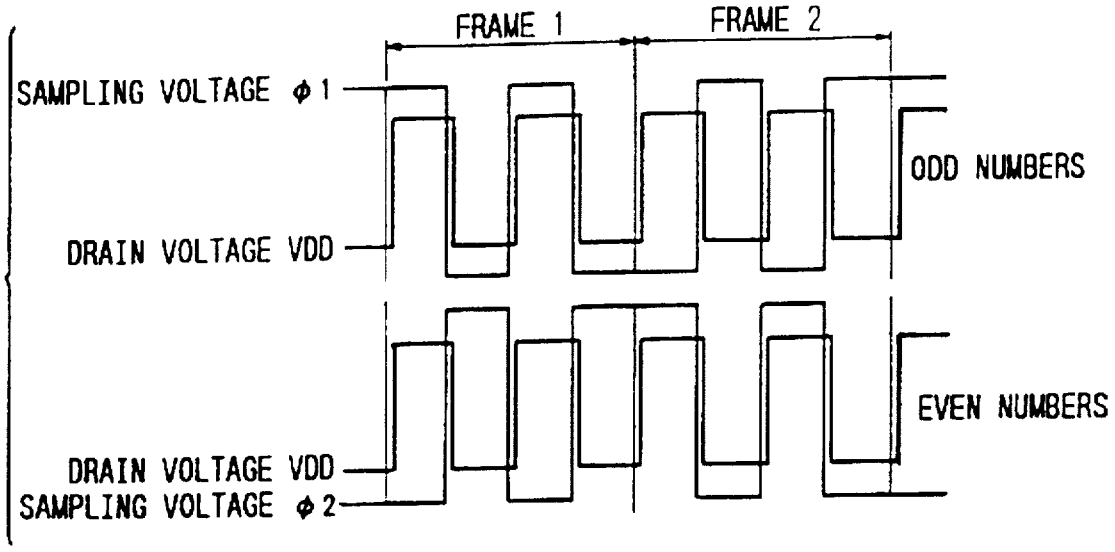
FIGS. 3(*a*)–3(*b*) show waveforms of drive voltages in another embodiment of the invention.
Figure 3B:
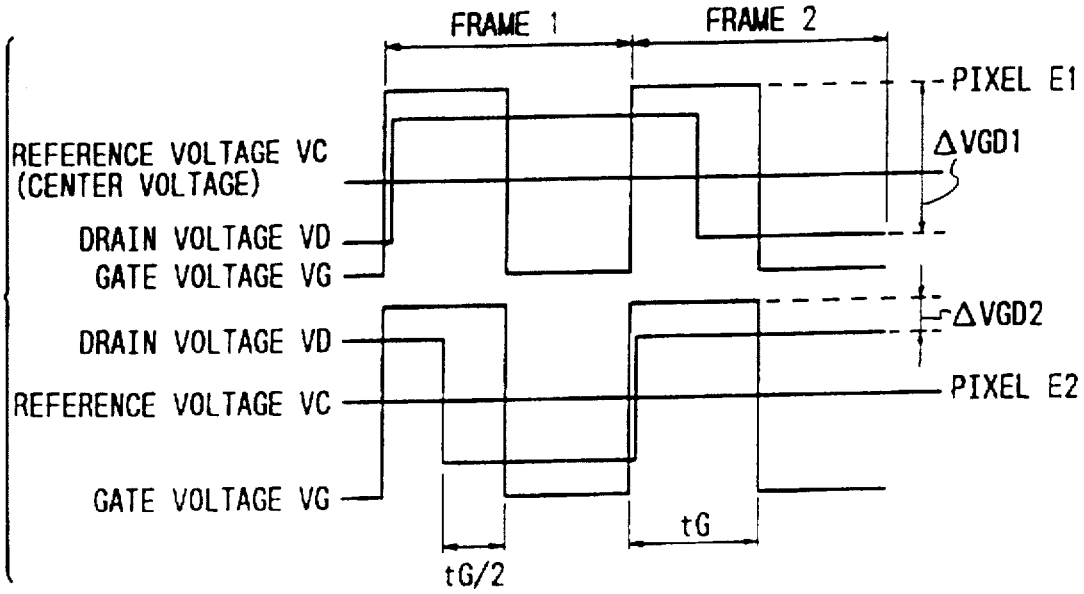

FIGS. 3(*a*)–3(*b*) show waveforms of drive voltages for one preferred embodiment of the invention in a display mode of black on a normally white background. FIG. 3(*a*) shows waveforms of sampling voltages θ applied to sampling TFTs and drain voltages VDD supplied from external driver ICs for odd numbers (D1, D3) and even numbers (D2, D4) of drain lines. FIG. 3(*b*) shows waveforms of gate voltages VG and drain voltages VD applied to pixel TFTs of pixel El on drain line D1 and pixel E2 on drain line D2, which correspond to the waveforms for odd numbers and even numbers of drain lines shown in FIG. 3(*a*). These waveforms correspond to the first row of pixels connected to the gate line G1 in FIG. 2, thereby corresponding to respective drive waveforms for driving pixel TFTs of pixels at intersections with drain lines of odd numbers (for instance, pixels El, E3 on drain lines D1, D3) and even numbers (for instance, pixels E2, E4 on drain lines D2, D4). For a display mode of white on a normally black background, there may be applied as a drain voltage a reference or center voltage value VC which is halfway between the maximum and minimum values of the drain voltages VD, or a voltage equal to a voltage VCOM applied to a common electrode opposing a pixel electrode of a pixel.

According to this preferred embodiment of the invention, sampling voltages θ1 and θ2 for sampling TFTs, i.e., TR1 and TR2, are reversed from frame to frame, whereas drain voltages VDD are not reversed from frame to frame. According to the drive method of the invention, as shown in FIG. 3(*b*), when the drain voltage VD changes to a voltage higher than the reference voltage VC, that is, when a difference ΔVGD between an on-voltage of the gate voltage VG and the drain voltage VD becomes small (i.e., ΔVGD2), during which period charging of pixel TFTs becomes insufficient, an overlap time between the on-voltage of the gate voltage VG and the drain voltage VD becomes tG. In contrast, when the drain voltage VD changes to a voltage lower than the reference voltage VC, that is, when ΔVGD becomes large (i.e., ΔVGD1), during which period charging of the pixel TFTs becomes more than sufficient, the overlap time becomes tG/2. A charging rate according to ΔVGD1 is sufficient, and therefore the overlap time of tG/2 for ΔVGD1 causes no problems in the display performance of the liquid crystal display device. As described above, according to this drive method of the invention, since the sampling voltages θ1 and θ2 corresponding to the period of tG are adapted to permit pixel TFTs to be charged sufficiently under drive conditions where the charging rate for charging the pixel TFTs decreases, and since the overlap time between the on-voltage of VG and VD can be increased when the charging rate is sufficient, an uneven and degraded quality of display due to insufficient charging of the pixel TFTs can be prevented.

Figure 4:
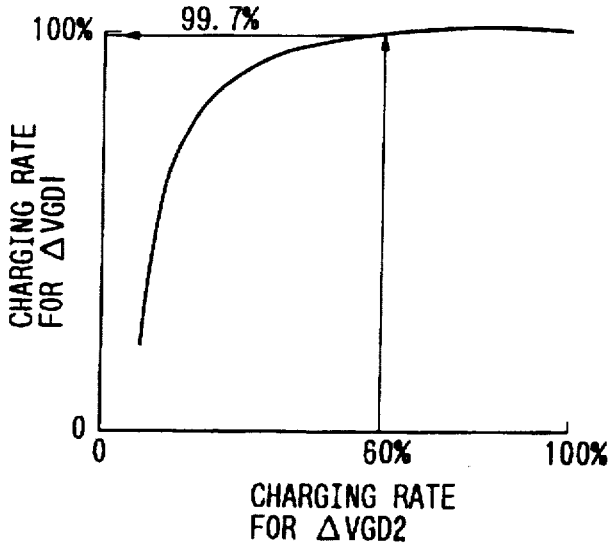
FIG. 4 shows a relationship between charging rates for charging pixel TFTs and differences ΔVGD between gate and drain drive voltages for the pixel TFTs in an embodiment of the invention.

FIG. 4 shows the difference in charging rates for charging pixel TFTs between ΔVGD1 and ΔVGD2. Here, referring to the voltages in FIG. 3(*b*), VG is a pulse voltage varying from 0 to 25 V, tG is 35 μs (which corresponds to a display device provided with 480 gate lines), VD has a maximum voltage VDH of 21 V and a minimum voltage VDL of 5 V, and the corresponding voltages ΔVGD are ΔVGD1=20 V and ΔVGD2=4 V. The pixel TFTs are amorphous silicon TFTs having a W/L ratio of 5 between channel width (W) and channel length (L), a mobility of 0.5 $cm^2/(Vs)$, and a threshold voltage of 2 V. A charging rate for a given source voltage with ΔVGD2=4 V is given on the abscissa, and a charging rate for a given source voltage with ΔVGD1=20 V is given on the ordinate. As will be clearly understood from this drawing, the charging rate for ΔVGD1=20 V is much greater than that for ΔVGD2=4 V. For example, when the charging rate for ΔVGD2 reaches 60%, a corresponding charging rate for ΔVGD1 has reached as much as 99.7% or more.

As described above, according to the drive method of the invention, since the overlap time between the on-voltage of VG and VD for pixel TFTs can be increased when a charging rate for charging the pixel TFTs is insufficient such that sampling voltages θ1 and θ2 corresponding to the period of tG may be adapted to permit the pixel TFTs to be charged sufficiently under drive conditions where the charging rate for charging the pixel TFTs decreases, a liquid crystal display device free from degradation in display quality due to insufficient charging can be provided.

Figure 5:
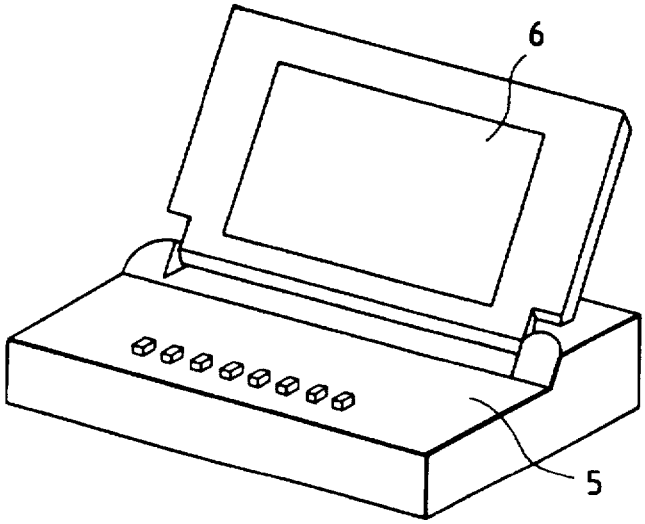
FIG. 5 shows a perspective view of a microcomputer including a liquid crystal display device according to the invention.

FIG. 5 is a perspective view of a laptop or notebook microcomputer having a keyboard unit 5 including most of the components of the microcomputer, and a display unit 6 including a liquid crystal display device driven by the drive method of the present invention. The drive method of the present invention enables the display unit 6 of the microcomputer to provide a high quality display, and since the liquid crystal display device of the display unit 6 has its sampling circuit formed on the same substrate as its pixel TFTS, a low-priced and light-weight microcomputer can be realized.

Figure 6:
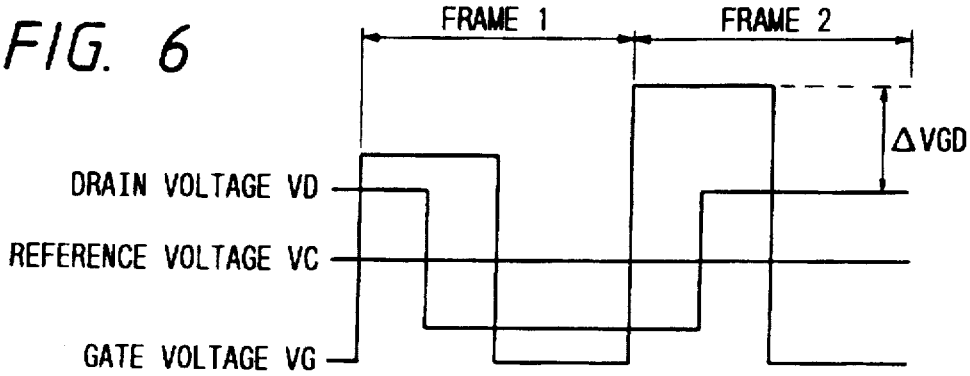
FIG. 6 shows waveforms of drive voltages in another embodiment of the invention.

FIG. 6 shows another drive method according to the present invention. One of the features of this drive method of the invention is that the on-voltage of the gate voltage VG at the time when the drain voltage VD is higher than the reference voltage VC during which period charging of pixel TFTs tends to be insufficient is higher than the on-voltage of the gate voltage VG at the time when the drain voltage VD is lower than the reference voltage VC during which period charging of the pixel TFTs is sufficient. This drive method of the invention can be implemented either by generating a frame switching signal in display control circuit 10 in FIG. 1 and outputting the frame switching signal together with low and high on-voltages to the gate drive circuit 1 which switches between the low and high on-voltages in accordance with the frame switching signal, or by switching between low and high on-voltages in the display control circuit 10 in accordance with frame numbers and outputting the switched on-voltage to the gate drive circuit 1. According to this drive method of the invention, even under such drive conditions that an overlap time between the drain voltage VD at the time it is higher than the reference voltage VC and the on-voltage of the gate voltage VG is short, since the difference ΔVGD between the gate voltage VG and the drain voltage VD can be increased when necessary to a value which is high enough to eliminate the inadequate charging of pixel TFTs which would otherwise occur when the drain voltage VD is higher than the reference voltage VC, it is possible to provide a liquid crystal display device which is free from degradation in display quality due to inadequate charging of pixel TFTs. It is needless to say that this drive method of the invention, when combined with the foregoing drive method of the invention, will provide an even greater capability of charging pixel TFTs.

Figure 7:
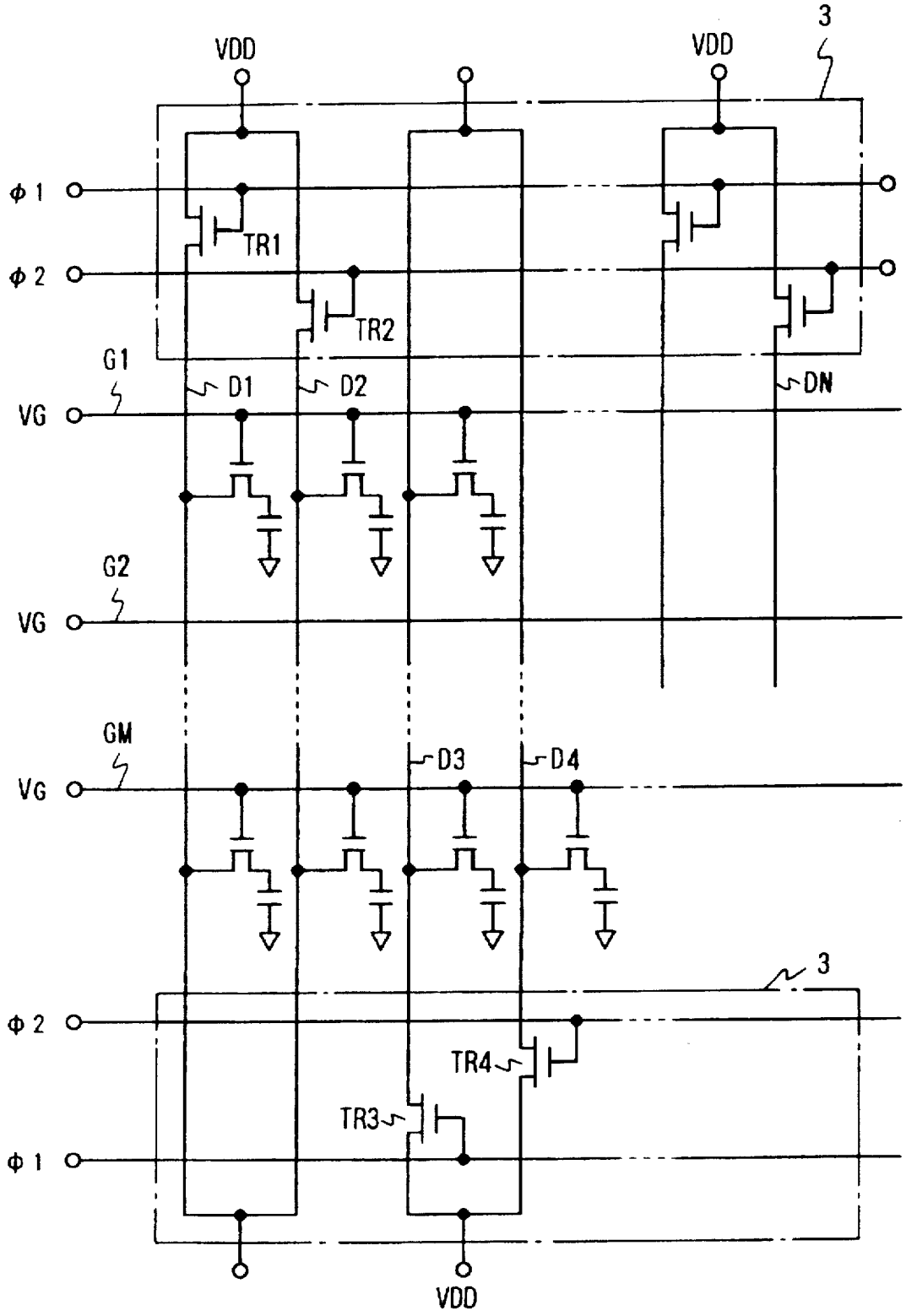
FIG. 7 shows an equivalent circuit of another embodiment of the invention.
Figure 8:
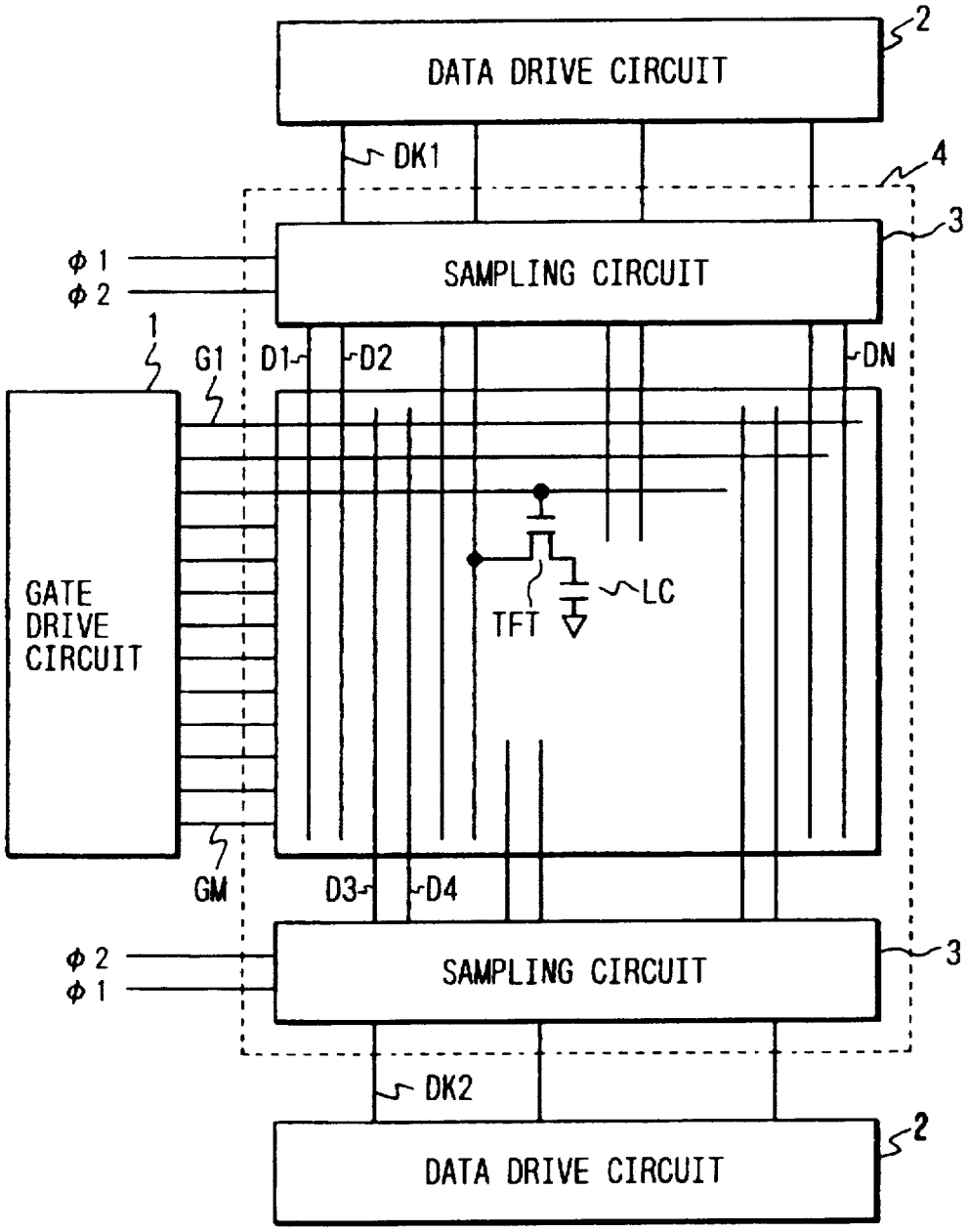
FIG. 8 is a schematic block diagram showing an overall configuration of a liquid crystal display device in the embodiment of FIG. 7.

Still another preferred embodiment of the invention will now be described. An equivalent circuit thereof is shown in FIG. 7, and a configuration thereof is shown in FIG. 8. This embodiment of the invention will be explained first by referring to a 2×4 pixel arrangement as in the description of the first embodiment of the invention. In the circuit of FIG. 7, sampling TFTs are placed on the upper and lower sides with respect to gate lines. Drain lines D1 and D2 are connected to a data drive circuit through sampling TFTs TR1 and TR2, respectively. Drain lines D3 and D4 are connected to a data drive circuit through sampling TFTs TR3 and TR4, respectively. Although the number of connections between the sampling circuits and data drive circuits is in effect the same as that in the first embodiment of the invention, a connection pitch available between the sampling circuit and the data drive circuit either on the upper or lower side becomes twice as wide compared with that in the first embodiment because the sampling circuits are provided separately on both sides, making it possible to prevent a decrease in manufacturing yield due to defective connections in the manufacture of high precision liquid crystal display equipment having a greater number of drain address lines.

FIG. 8 is a schematic diagram explanatory of an active matrix liquid crystal display device utilizing the equivalent circuit in FIG. 7. In reference to this drawing, a plurality of liquid crystal cells (LC) are arranged in rows and columns in a matrix, each cell being provided with a pixel TFT, and sampling circuits 3 are formed on a same substrate 4, then respective liquid crystal cells are energized through switching operations of the TFTs. Then, gate address lines Gl through GM each connecting respective gate electrodes of TFTs aligned in a row are supplied with gate voltages from a gate drive circuit 1 sequentially to turn on the gates line by line. On the other hand, drain address lines D1 through DN each connecting respective drain electrodes of TFTs aligned in a column are supplied sequentially with relevant data voltages corresponding to respective gate lines which were turned on as above from data drive circuits 2 through sampling circuits 3 to energize respective liquid crystal cells. Further, the sampling circuits 3 are provided with sampling TFTs associated with each of the foregoing drain lines as shown in FIG. 7, and a plurality of sampling voltages θ1 and θ2 are supplied to the sampling TFTs as gate voltages while the pixel TFT gate voltages are on-voltages. Through such an arrangement, the drain lines are grouped together corresponding to the number of sampling voltages, and in such a manner are connected from the sampling circuits 3 to the data drive circuits 2. If at least the sampling circuits 3 among the foregoing peripheral circuits are permitted to be formed on the same substrate together with the pixel TFTs, the number of connections between the sampling circuits 3 and the data drive circuits 2 can be reduced corresponding to the number of sampling voltages. The sampling circuits are formed on a substrate 4 (normally a transparent substrate made of glass or the like) in the same manner as the pixel TFTS. In such a case when the number of sampling voltages is, for example, two, drain lines D1 and D2 are grouped together as line DK1 for connection to an externally provided data drive circuit, and drain lines D3 and D4 are grouped together as line DK2 for connection to an externally provided data drive circuit. In consequence, the number of connections between data drive circuits 2 and the substrate 4 carrying the pixel TFTs and sampling circuits 3 formed concurrently thereon is halved, that is, the number of driver ICs constituting the data drive circuits 2 is capable of being halved. Because the sampling circuits 3 are capable of being formed readily by the same process as the pixel TFTs, there is an advantage that the production cost of the liquid crystal display equipment is capable of being reduced substantially due to the halved number of driver ICs. According to this embodiment of the invention, because connections are provided on both sides, that is, upper and lower parts, of a substrate carrying pixel TFTs, in comparison with the first embodiment of the invention, a space pitch or gap available between connections between the substrate and an externally provided driver IC circuit becomes twice as wide as that in the first embodiment, thereby making it possible to substantially improve reliability of connections. The drive method according to this embodiment of the invention is essentially the same as that of the first embodiment of the invention. The drive method of the second embodiment of the invention can, of course, be applied to the same purpose and effect.

Figure 9:
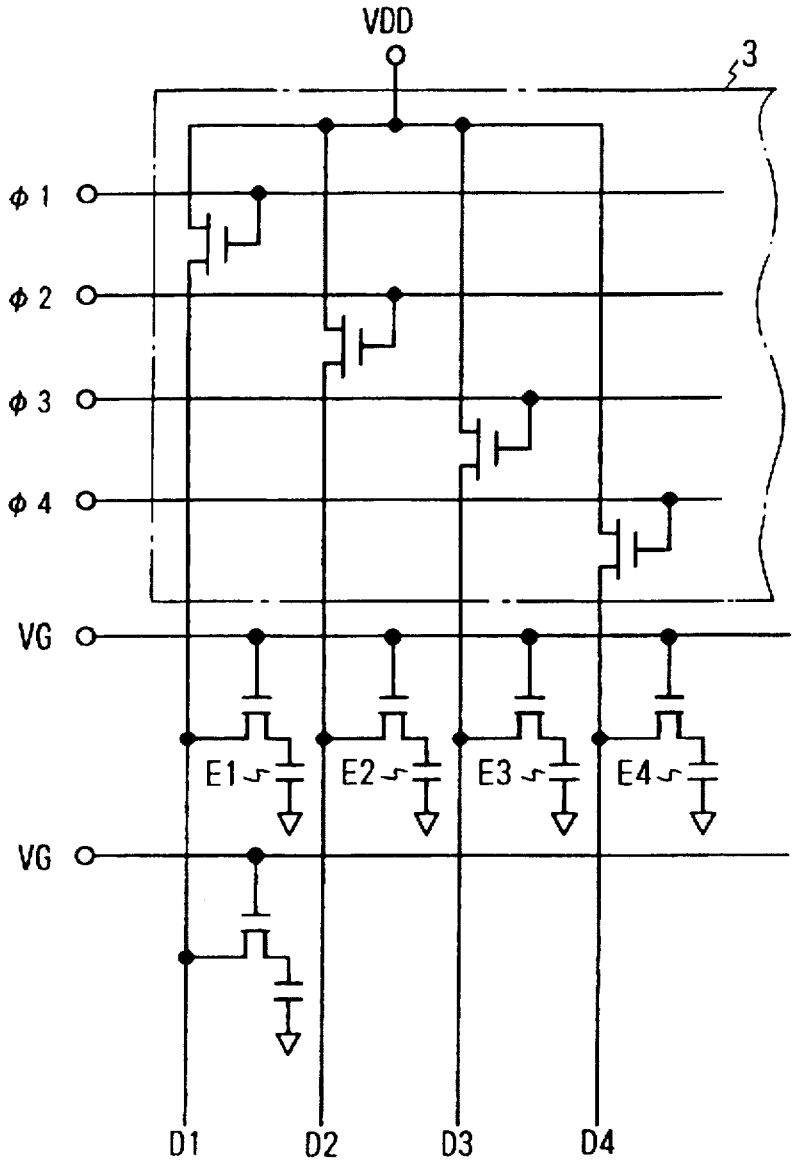
FIG. 9 shows an equivalent circuit of another embodiment of the invention.
Figure 10:
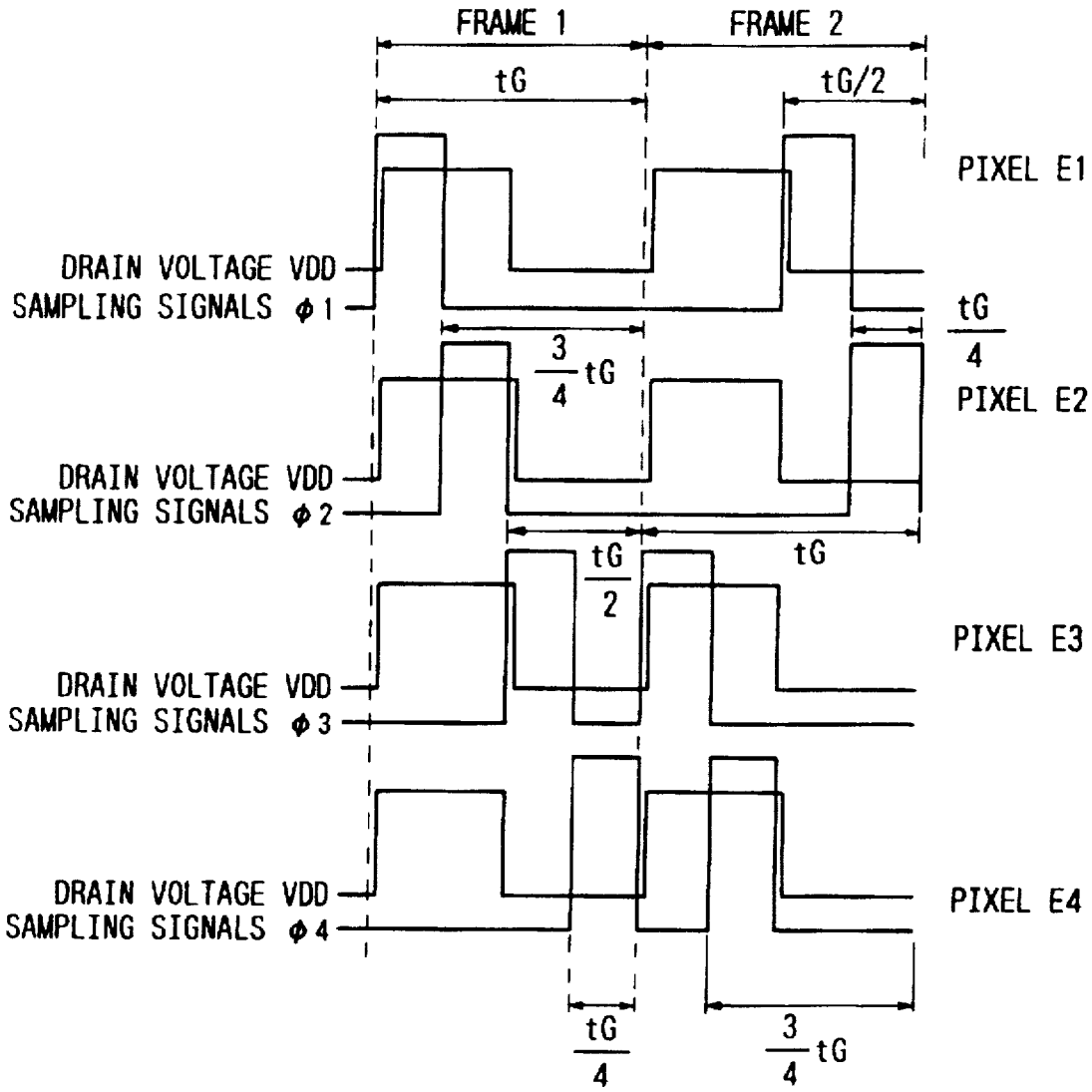
FIG. 10 shows waveforms of drive voltages in the embodiment of FIG. 9.

A fourth embodiment of the invention will now be described. An equivalent circuit of the fourth embodiment of the invention is shown in FIG. 9, and a drive method thereof is shown in FIG. 10. The equivalent circuit of FIG. 9 explains a case where the number of sampling voltages is 4. Therefore, 4 drain lines will be grouped together and will be connected, through a sampling circuit 3 formed on the same substrate as pixel TFTs, to an externally provided drain drive circuit. Thereby, there turns up an advantage that even greater cost reduction is capable of being achieved because the number of driver ICs on the drain side can be reduced to ¼.

FIG. 10 shows timing charts for sampling voltages θ1 through θ4 which are gate voltages to be applied to respective sampling TFTs corresponding to drain lines D1 through D4, and for drive voltage waveforms VDD which are output voltages from the drain drive circuit. These drive waveforms correspond to a display mode of black on a normally white background. In reference to this drawing, although voltages to be applied to pixels are not specified, within a tG period in frame 1 is applied a voltage VD higher than the reference voltage VC corresponding to θ1 and θ2 in the tG period, and in frame 2, all of θ1 through θ4 are reversed in polarity. Thereby, in frame 2 a voltage VD higher than the reference voltage VC is capable of being applied corresponding to θ3 and θ4 within a tG period. Thereby, from relationships between VG and VD as shown in FIG. 10, with respect to pixel E1, an overlap time between VG and VD the value of which is higher than the reference voltage VC is given by tG, and that when the value of VD is lower than the reference voltage VC is given by tG/2. With respect to pixel E2, an overlap time between VG and VD the value of which is higher than the reference voltage VC is given by ¾×tG, and that when the value of VD is lower than the reference voltage VC is given by tG/4. With respect to pixel E3, an overlap time between VG and VD the value of which is higher than the reference voltage VC is given by tG, and that when the value of VD is lower than the reference voltage VC is given by tG/2. With respect to pixel E4, an overlap time between VG and VD the value of which is higher than the reference voltage VC is given by ¾×tG, and that when the value of VD is lower than the reference voltage VC is given by tG/4. As a result, in every case of the above, the overlap time between VG and VD the value of which is higher than the reference voltage VC is effected to be longer than the overlap time between VG and VD the value of which is lower than the reference voltage VC. In comparison with the prior art drive methods whereby the overlap time between VG and VD the value of which is higher than the reference voltage VC is given by tG/4, thereby causing degradation in display quality due to inadequate charging of pixels, this novel drive method of the invention is capable of providing liquid crystal display equipment having a greatly improved display quality free from such inadequate charging.

In the embodiments of the invention set forth heretofore, the number of sampling voltages was described as being two or four by way of example without being limited thereto, and other variants of the number of sampling voltages should be construed as being usable with the drive method of the invention. Further, in the foregoing embodiments of the invention by way of explanation, for example, in FIGS. 1 and 8, sampling circuits are shown as being formed on the same substrate as the pixel TFTS. The drive method of the invention is also capable of being employed in such an application where the functions of the sampling TFTs are performed by externally provided driver ICs.

Figure 11:
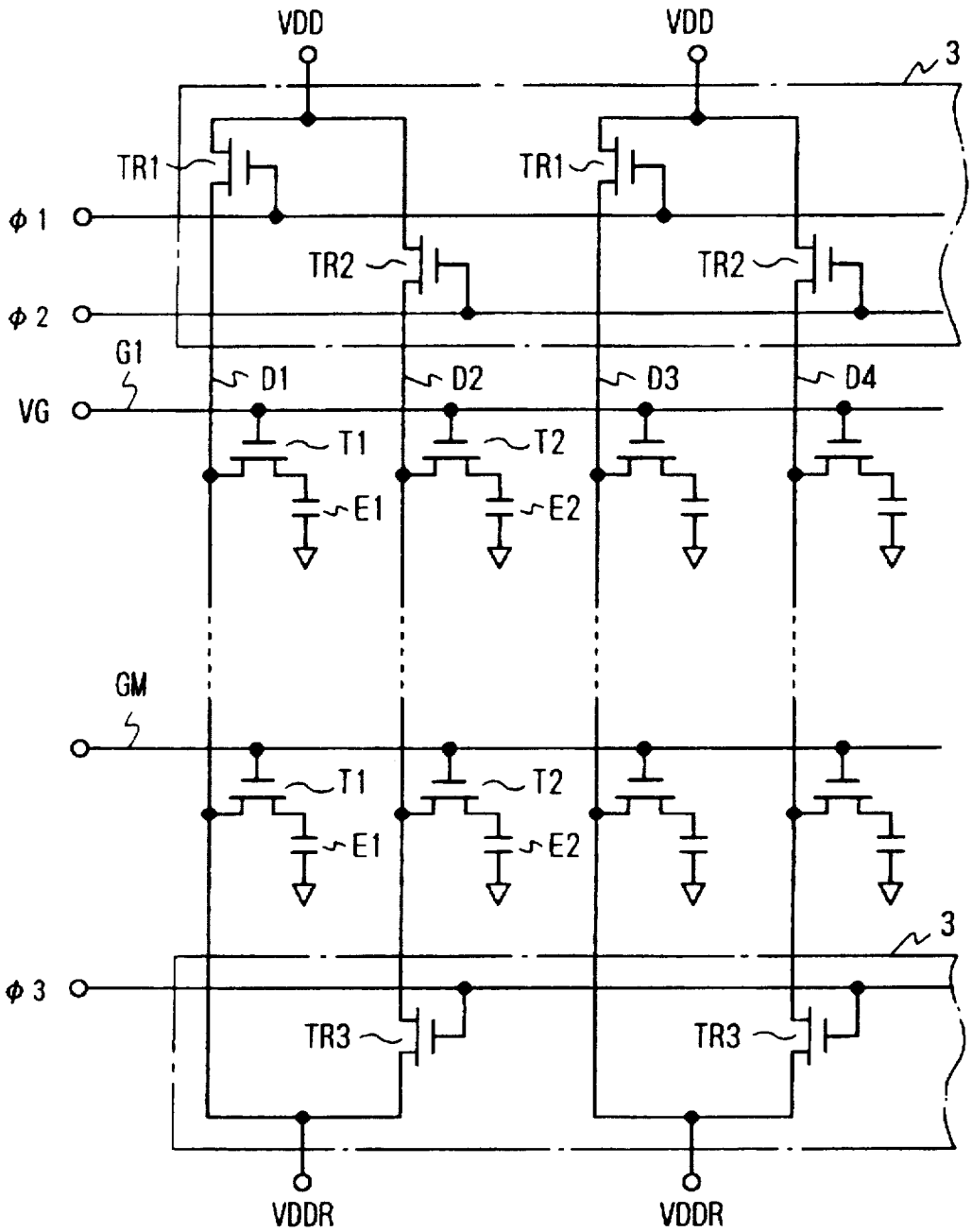
FIG. 11 shows an equivalent circuit of another embodiment of the invention.
Figure 12:
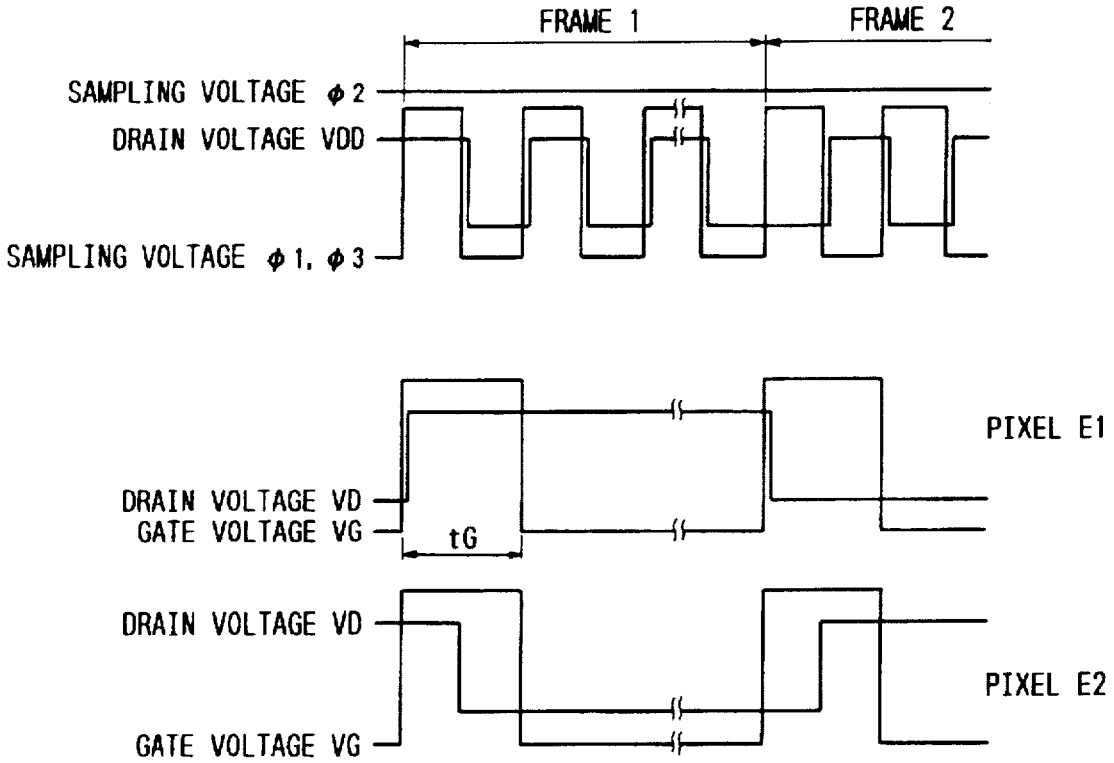
FIG. 12 shows waveforms of drive voltages in the embodiment of FIG. 11.

Further, a fifth embodiment of the invention having a redundancy structure for compensating for discontinuities in drain lines by connecting a set of drain lines into a loop, and a liquid crystal display device comprising such a structure, will now be described. FIG. 11 shows an equivalent circuit thereof, and FIG. 12 shows drive waveforms thereof.

FIG. 11 shows, by way of example, key components of the equivalent circuit, where drain lines D1 and D2 connecting a pixel E1 in the first column and a pixel E2 in the second column, respectively, are connected into a loop, and three TFTs, i.e., TR1, TR2 and TR3, are inserted into the loop as switching elements outside the effective display area (in peripheral portions thereof). Drive waveforms in this circuit will differ according to locations of respective discontinuities in the drain lines.

In a case when there are no discontinuities in the drain lines, θ3 is held constantly at a low level, thereby holding TR3 off. Other operations, for example, operations of θ1, θ2 and the like, are the same as for the structure of FIG. 2. Sequences of operation required when there is any discontinuity in the drain line D1 will now be described with reference to FIG. 12.

A sampling voltage θ2 is kept constantly at a high level so as to keep TR2 on. During a gate voltage selection time tG for pixel TFTs, preset sampling voltages θ1 and θ3 are supplied to the gates of relevant sampling TFTs. In the former half period of tG, TR1, TR2 and TR3 are all turned on by these sampling voltages. A discontinuity position XD is also energized underneath thereof with the voltage supplied through TR2, D2, TR3 and D1, thereby the whole loop of D1 and D2 is charged to the VD level. Then, in the latter half of tG, TR1 and TR3 are turned off, and only the drain line D2 is charged to the VD level, with the potential of the drain line D1 remaining the same. That is, the liquid crystal capacitances of pixels E1 and E2 are effected ultimately to be charged to the voltage VD. During the gate voltage selection time tG in frame 2, the same sampling voltages as in frame 1 are applied whereas only the drain voltages are reversed with respect to a zero voltage (positive and negative signs). Eventually, the liquid crystal capacitances of pixels E1 and E2 are charged to the voltage VD. Through repetition of frame 1 and frame 2, the liquid crystal cells are activated in an AC mode. In case any discontinuity occurs in D2, it can be compensated for by exchanging drive waveforms in FIG. 12 between θ1 and θ3. According to the circuitry configuration embodying the invention, there is required only one drain line for connecting between respective pixels, thus, short-circuit failures between drain lines will not increase even when a redundancy loop is formed. Further, intensity in a display screen will not decrease because a ratio of wiring area to effective display area does not increase.

Further, according to the circuitry structure of the invention, defects and faulty parts can be detected in the early stage of a manufacturing process, thereby making it possible to stop the manufacturing process from going on any further (contributing to cost reduction). The manufacturing process of liquid crystal display devices can be divided roughly into the following three steps: (1) a TFT process for forming thin film transistors and their related circuits on a glass substrate, (2) a liquid crystal process for opposing the above substrate against another glass substrate to seal a liquid crystal therebetween thereby to form liquid crystal capacitances, and (3) a module process for connecting externally provided driver circuits to the extremities thereof. In order to effectuate reduction of manufacturing cost, it is necessary to detect irreparable defects and faulty parts in the earlier stage of the manufacturing process and to prevent the same from advancing to the subsequent process. The circuitry structure of the invention makes it possible to detect short circuits between drain lines at the end of the TFT process. That is, such detection may be effected, for example, through a continuity test between terminals VDD and VDDR with TR2 being turned on, and with TR1 and TR3 being turned off. Under normal conditions, there will be no continuity between the terminals VDD and VDDR, whereas when any short circuit occurs between the drain lines, there will be continuity between the terminals VDD and VDDR, thus indicating the occurrence of a short circuit.

Figure 13:
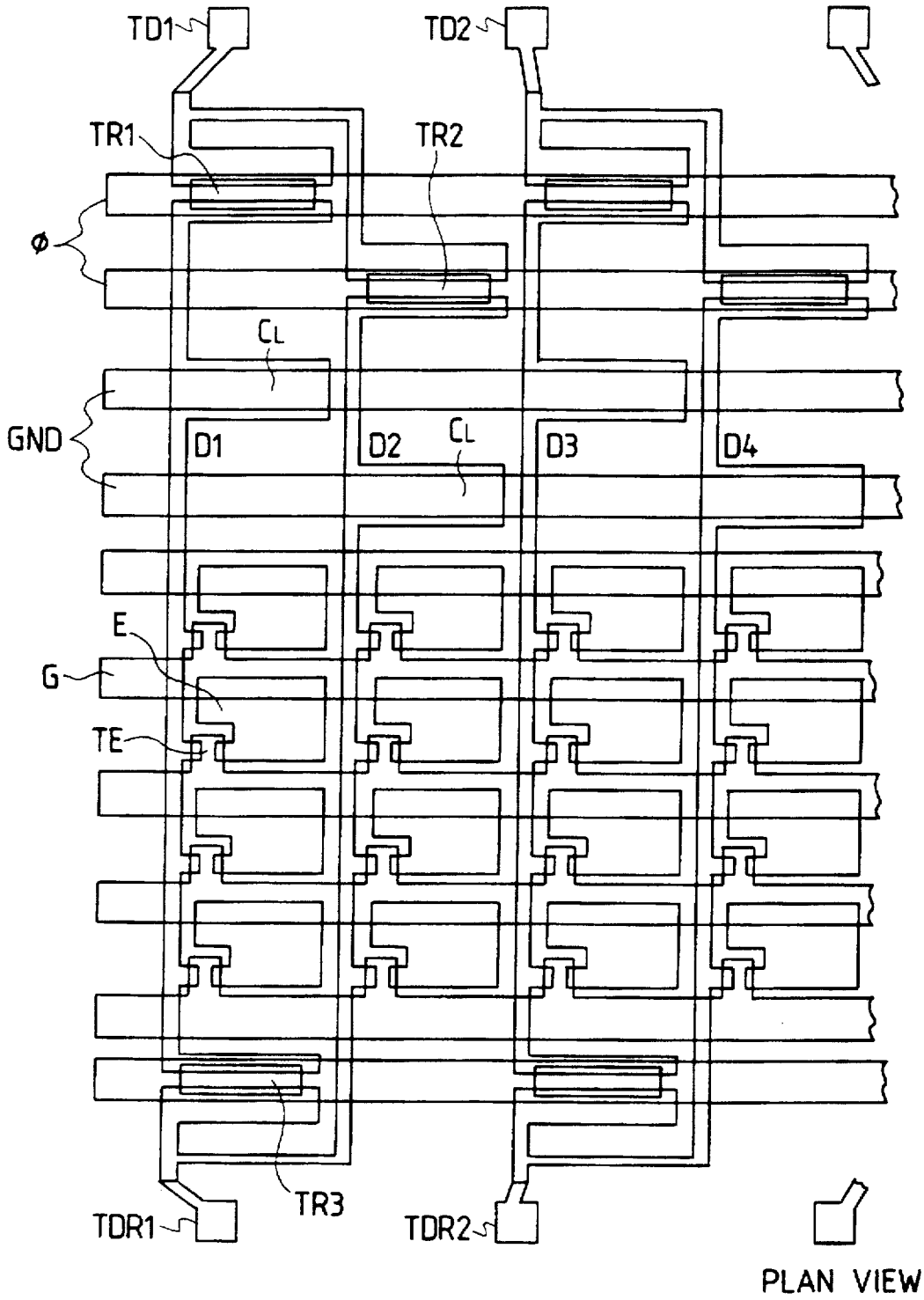
FIG. 13 shows a plan view of a main portion of a liquid crystal display device in the embodiment of FIG. 11.

FIG. 13 is a plan view of a main portion of the liquid crystal display device of the embodiment of FIG. 11.

Pixels each having a vertical pitch of 330 μm and a lateral pitch of 110 μm are arranged in rows and columns in a matrix, with the number of pixels in a row being 1920 and that in a column being 480. A transparent electrode IT0 is utilized as an electrode of a liquid crystal capacitance LC for each pixel. Pairs of TD1, TD2 and TDR1, TDR2 are terminals (pads) through which drain voltages are supplied from externally provided drive circuits, the former pair being normally operating pads and the latter pair being redundancy or backup pads. The pitch between the pads or terminals in each pair is 180 μm. Sampling transistors TR1, TR2 and TR3 are thin film transistors having a polycrystalline silicon film as an active layer (region). Pixel transistors TE are thin film transistors having an amorphous silicon film as an active layer (region). Drain address lines D, gate address lines G, and sampling transistor gate address lines θ are lamination wiring made of Al, Cr, ITO and the like. A pair of drain lines immediately next to each other form a loop circuit containing sampling transistors TR1, TR2 and TR3. According to the structure of the embodiment of the invention, in spite of the redundancy circuit configuration implemented therein, only a single drain line is provided for connecting between pixels E in a column. Thereby, a distance between drain lines (with a pitch of 330 μm between pixels) may be maintained at the same distance as before, and thus the occurrence of short circuits between drain lines is prevented from increasing, and the drain line discontinuities are enabled to be remedied. Further, because a surface ratio (normally about 7%) of opaque drain lines with a line width of 8 μm does not increase, implementing the redundancy structure in liquid crystal display equipment will not cause the intensity thereof to be reduced.

Further, in reference to FIG. 13, the electrode of a pixel E is formed partially overlying the preceding gate line via an interlayer insulation film interposed therebetween, thus forming a capacitance. This is equivalent to increasing a liquid crystal capacitance, thus providing an advantage that distortion in waveforms to be applied to liquid crystal cells is suppressed and reduced. Further, in any variants of the invention where these capacitances are not provided, the scope and spirit of the present invention should not be construed as being impaired.

Further, in reference to FIG. 13, lines GND are formed between pixels E and sampling TFTs, i.e., TR1, TR2. Capacitances CL are formed by laminating drain lines D1, D2 and lines GND via interposed insulation films, respectively. The lines GND are electrically grounded. Capacitance CL has an effect to permit distortion in waveforms applied to drain lines to pass through. Any variants of the invention with omission of these lines GND and capacitances CL should not be construed as impairing the scope and spirit of the invention.

This embodiment of the invention is characterized in that discontinuities in the drain lines are capable of being remedied by changing drive methods according to the invention. When there are no discontinuities in the drain lines, display operations are carried out according to the drive method shown in FIGS. 3(*a*)–3(*b*). When there occurs any discontinuity in the drain lines, the discontinuity is capable of being readily remedied by supplying terminal TD with drain voltages from an externally provided drive circuit, and driving according to the drive method of FIG. 12. Further, when one of the sampling transistors, i.e., TR1 and TR2, fails to function properly or is deteriorated in its characteristics, this can be remedied as follows to ensure proper functioning. First, a drain voltage is supplied from pad TDR1. At this time, sampling voltages θ1 and θ2 are kept constantly at a low level to keep TR1 and TR2 off. Through a switching operation of TR3, the applied drain voltage is divided between TR1 and TR2. Namely, with respect to the drive waveforms in FIG. 12, by holding sampling voltages θ1 and θ2 constantly at a low level, the display operation is capable of being effectuated. Among the drive methods according to the present invention, those other than that of FIGS. 3(*a*)–3(*b*) involve such a problem that a charging operation of positive polarity TFTs tends to become inadequate. In such a case, it is preferred for a range of service temperatures of liquid crystal display equipment to be limited to a certain extent, or to employ the drive method of the invention as shown in FIG. 6 where charging capability is enhanced by increasing and decreasing the gate voltage appropriately. As heretofore stated, according to the embodiment of the invention, it is possible to detect short circuits between drain lines or discontinuities in drain lines in the early stage of a manufacturing process of liquid crystal display units (prior to liquid crystal sealing), thereby making it possible to stop the manufacturing process from going on any further, thus contributing to cost reduction.

Figure 14:
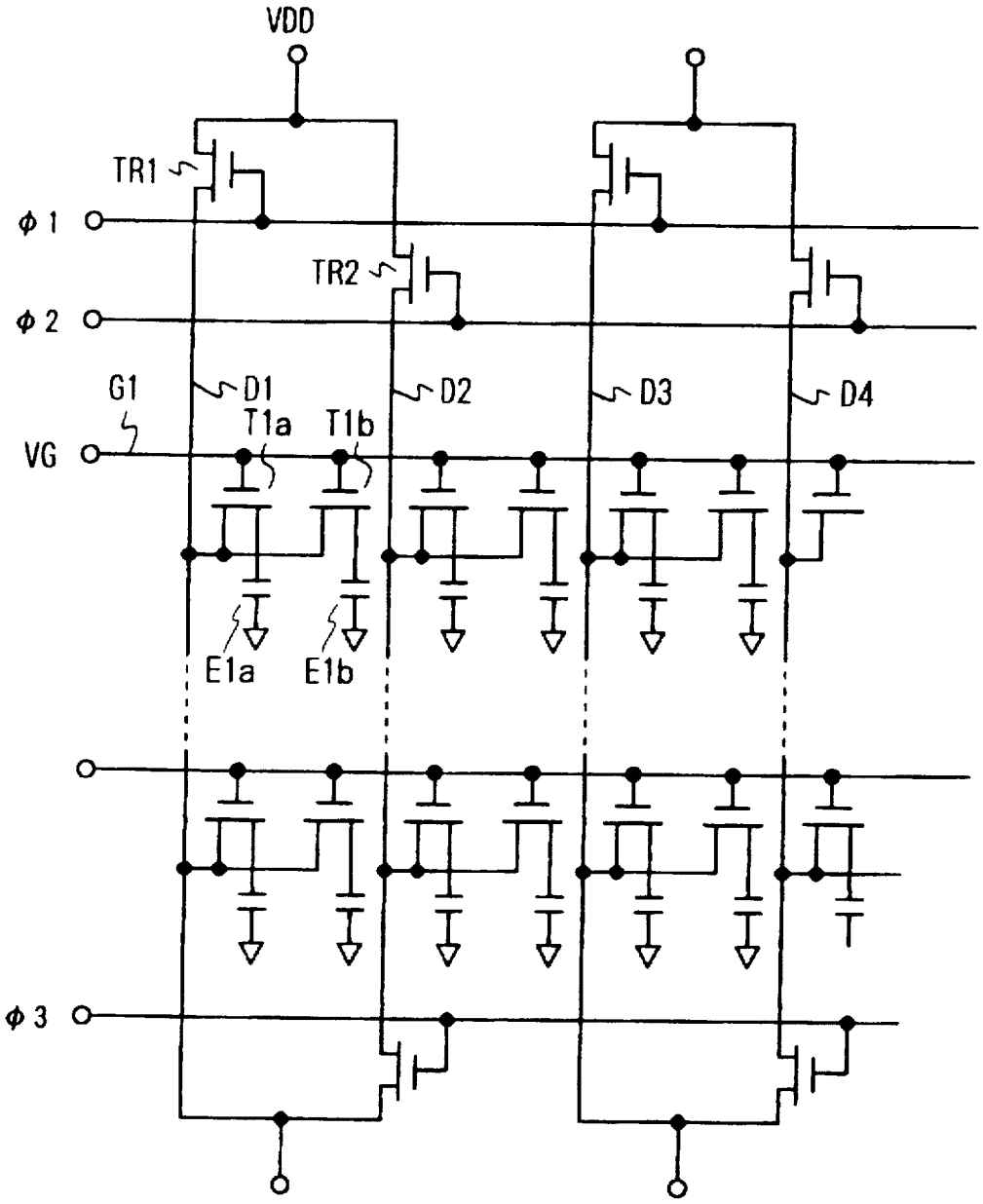
FIG. 14 shows an equivalent circuit of another embodiment of the invention.

Further, according to this embodiment of the invention, a unit pixel is comprised by a single TFT and one pixel electrode, such that the pixel itself is not composed to have a redundancy structure. Providing a redundancy structure to the pixel should not be construed as impairing the scope and spirit of the invention. For example, as shown in FIG. 14, the electrode of a unit pixel may be divided into two sub-electrodes Ea and Eb, each of which is provided with a TFT Ta or Tb, respectively. Further, the sampling TFTs may be provided in upper and lower parts thereof in the number of two, respectively. Such arrangements of sampling transistors in upper and lower portions in pairs will ensure normal drive operations even when two transistors thereof may fail because the remaining two will be able to take over drive operations.

Further, heretofore, by way of example, in the description of the drive methods of the invention, two drain lines are connected to one common address line. However, the number of drain lines to be connected to one common address line should not be limited to two, and any variants of the invention having three or more drain lines connected to one common address line will fall within the scope and spirit of the invention.

Still another drive method for displaying a half tone or intermediate gradation display according to the invention will now be described.

Figure 15:
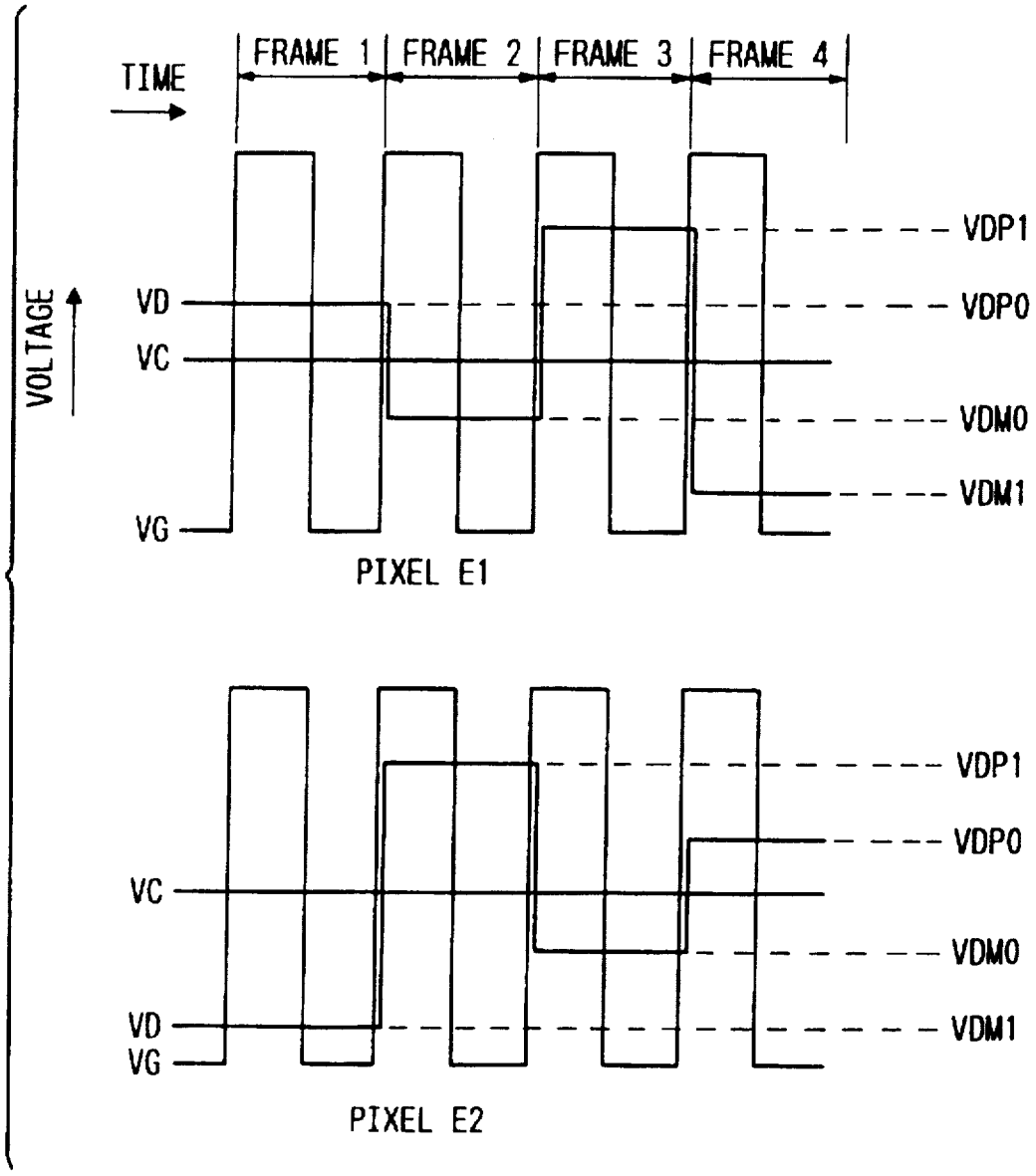
FIG. 15 shows waveforms of drive voltages for performing half tone or intermediate gradation display in another embodiment of the invention.

Sequences of operation will now be described with reference to FIGS. 15 and 16(*a*)–16(*b*). FIG. 15, where VDP0, VDM0, VDP1 and VDM1 are applied as drain voltages, shows energizing waveforms for energizing pixels E1 and E2 which are abutted along a gate line through the use of the FRC drive method. Here, a set of VDP0 and VDM0, or VDP1 and VDM1, is in a symmetrical relationship with each other with respect to a reference voltage VC, with absolute values of their differential voltages from VC being the same. Further, in this case, an absolute value of a difference from VC for VDP0 or VDM0 is set to become smaller than an absolute value of a difference from VC for VDP1 or VDM1. In order to perform gradation or grey scale display without utilizing the FRC drive method, it is necessary to energize liquid crystal cells by applying AC voltages. A set of VDP0 and VDM0 will provide one gradation level, and a set of VDP1 and VDM1 will provide another gradation level, thus providing two levels of gradation display.

In order to increase the number of levels in gradation display through the use of the FRC drive method utilizing only two sets of the voltages defined as above, as is indicated in FIG. 15 by the waveforms corresponding to pixel E1, also supposing one frame being defined by a cycle of a pulse voltage VG, with four frames thereof being defined as a unit for repeating VDP0, VDM0, VDP1 and VDM1, as a result, a new gradation level is capable of being added for display, which is defined approximately at an intermediate absolute value between a differential absolute value which was taken between VDP0 or VDM0 and VC, and another differential absolute value taken between VDP1 or VDM1 and VC. With respect to the abutted pixel E2, because according to the FRC drive method a unit frame increases from the conventional two frames to four frames, flickering on the screen increases. In order to solve this problem through a spatial processing, it is necessary to alternate the polarity thereof from that of pixel E1, and further to change voltages, thereby VDM1, VDP1, VDM0 and VDP0 are displayed in repetition in a unit of four frames.

Figure 16A:
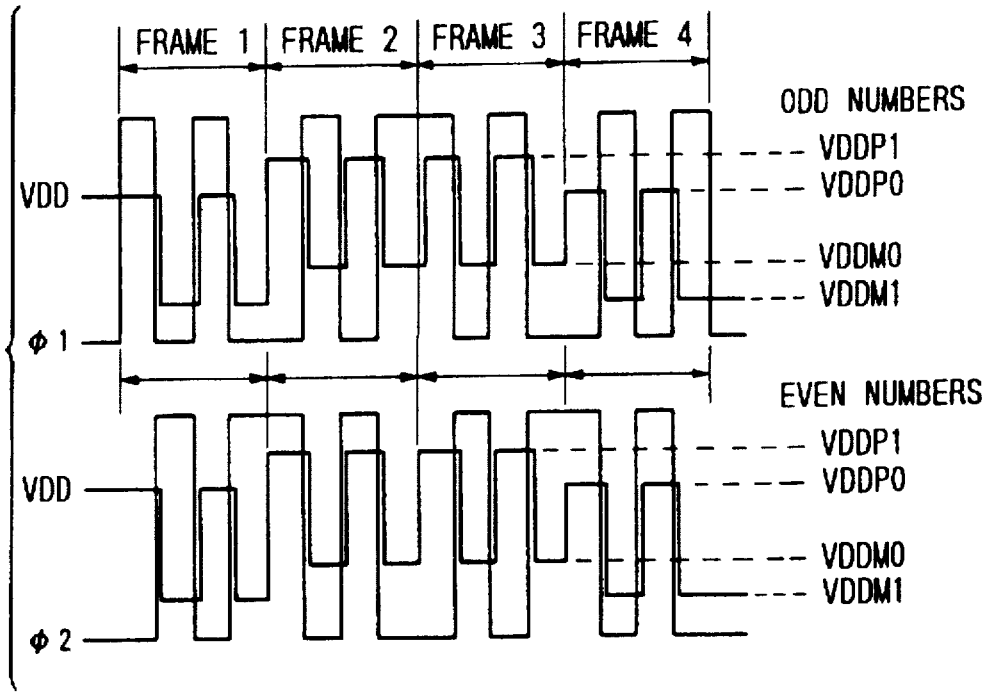
FIGS. 16(*a*)–16(*b*) show waveforms of drive voltages for performing half tone or intermediate gradation display in another embodiment of the invention.

FIGS. 16(*a*)–16(*b*) are diagrams explanatory of a drive method of one example of the invention. FIG. 16(*a*) shows relationships between gate voltages θ of sampling TFTs and drain voltages VDD (VDDP0, VDDM0, VDDP1 and VDDM1) to be supplied from externally provided driver ICs. Voltage waveforms applied to odd numbered drain lines (D1, D3) and even numbered drain lines (D2, D4) are shown separately. FIG. 16(*b*) shows voltage waveforms of gate voltages VG to be applied to pixel TFTs and of drain voltages VD (VDP0, VDM0, VDP1 and VDM1) to pixel TFTs E1 and E2 outputted from the foregoing sampling TFTs. These waveforms correspond to the first row, that is, G1 in the circuitry of FIG. 1, and in particular, they correspond to respective pixels associated with the odd numbered drain lines (pixels E1, E3 on the line D1) and even numbered drain lines (pixels E2, E4 on the line D2), respectively.

In this example of the invention, sampling voltages θ1 and θ2 to be applied to the sampling TFTs TR1 and TR2 at their gate electrodes are reversed in polarity for every frame. Conventional drive methods, in contrast, reverse drain voltages for every frame, instead of reversing sampling voltages θ1 and θ2. In such conventional drive methods, in order to reverse as many lines of drain voltages as required, the configurations of the equipment become very complicated. In addition, because the drain voltage itself is reversed for every frame, uneven display cannot be reset or eliminated.

Figure 16B:
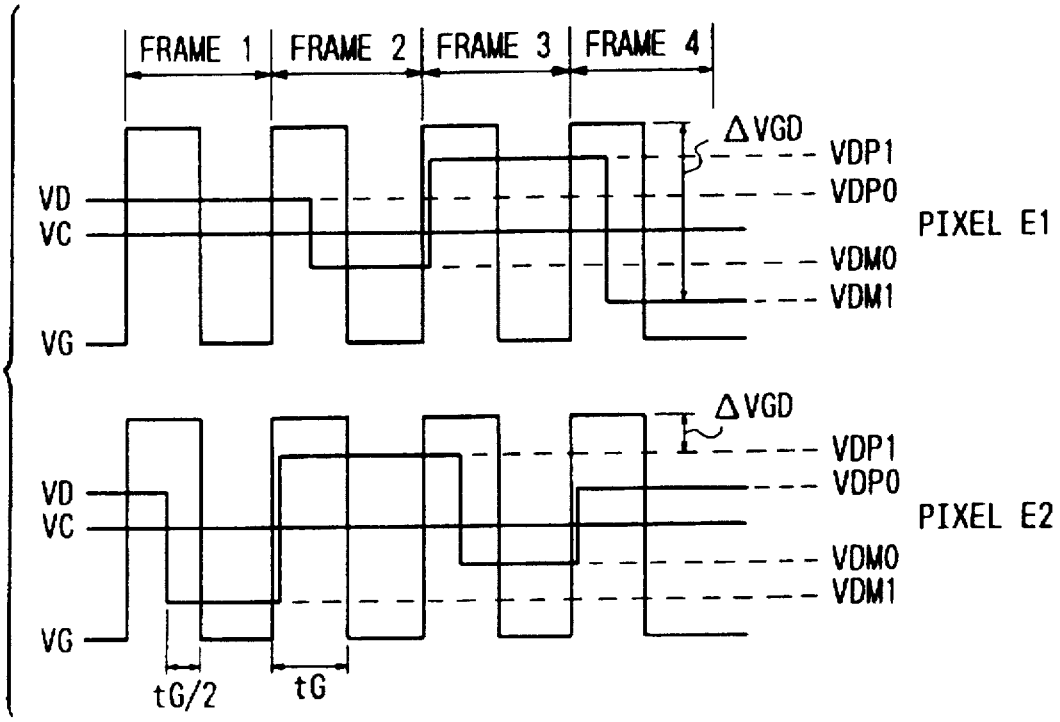

According to the drive method of the invention, as shown in FIG. 16(b), when a drain voltage VD is higher than the reference voltage VC (i.e., VDP1, VDP0), during which period charging of pixel TFTs becomes insufficient, that is, when ΔVGD is small, an overlap time between the gate voltage VG and the drain voltage VD is given by tG, whereas, when a drain voltage VD is lower than the reference voltage VC (i.e., VDM0, VDM1), during which period charging of the pixels becomes more than enough, that is, when ΔVGD is large, the overlap time thereof is given by tG/2. Even though the overlap time is shortened to tG/2, because ΔVGD is large enough to provide a sufficient charging power, a multilevel gradation display by means of the FRC drive method is capable of being implemented without causing any substantial problems and degradation in display quality of the liquid crystal display equipment. As set forth hereinabove, according to this drive method of the invention, Δ1 and Δ2 corresponding to a tG period in the FRC drive method are preferentially charged under drive conditions where the charging power for charging pixel TFTs becomes inadequate, such that the overlap time between VG and VD may be prolonged, thereby making it possible to prevent the occurrence of an uneven display due to inadequate charging. Further, even such drive methods as utilizing a conventional timing operation is capable of providing a liquid crystal display device having a high quality display which is driven by the FRC drive method through the employment of a novel drive method of the invention whereby the gate voltage VG to be applied at the time when the drain voltage VD is higher than the reference voltage VC during which period charging of pixel TFTs becomes inadequate is a predetermined gate voltage which is higher than a gate voltage VG to be applied at the time when the drain voltage VD is lower than the reference voltage VC.

Further, a liquid crystal element suitable for use in the present invention is preferably an optical scattering type liquid crystal. The optical scattering type liquid crystal is a liquid crystal material which assumes a smectic A-phase of a molecular structure. The smectic A-phase liquid crystal, when no electrical field is applied, has a molecular orientation of a so-called focal conic structure which scatters light. On the other hand, when an electrical field is applied, it assumes a homeotropic structure with its molecular long axes arrayed in a direction of the electrical field, making itself transmissive to light or becoming transparent.

So-called polymer scattered liquid crystals with optical scattering liquid crystals and nematic crystals contained in capsules in polyvinyl alcohol permit liquid crystal elements readily to be formed in a thin film, thereby making it possible to provide a light-weight and thinner LC structure, thus providing advantages over the conventional structures which have to seal liquid crystal elements between opposing glass substrates.

As set forth hereinabove, according to the present invention, uneven display or degradation in the quality of display due to the inadequate charging of liquid crystal capacitances for thin film transistors is capable of being eliminated. Further, even in the multilevel gradation display by means of the FRC drive method, uneven display or degradation in the quality of display due to inadequate charging of the liquid crystal capacitances for the thin film transistors is capable of being eliminated.

A liquid crystal display device incorporating partially a built-in drive circuit which is readily capable of being formed on the same substrate as that on which pixel TFTs are formed is operable without causing any problems due to inadequate charging of pixels or the like, and thereby a substantial reduction in the number of driver Ics is realized. In addition, the reliability of connections in the circuits thereof is capable of being improved greatly, thus making it possible to provide microcomputer equipment incorporating a low cost liquid crystal display device as well as its related liquid crystal display equipment.

What is claimed:

1. A method for driving a liquid crystal display device, the liquid crystal display device including a liquid crystal pixel, and a thin film transistor having a source, a drain, and a gate, the source of the thin film transistor being coupled to the liquid crystal pixel, the method comprising the steps of:

applying a drain voltage indicative of a video signal to the drain of the thin film transistor, the drain voltage having a first drain voltage value at a first time;

applying a gate voltage pulse to the gate of the thin film transistor, the gate voltage pulse being a gate voltage which changes from a first gate voltage value to a second gate voltage value at a second time after the first time, and changes from the second gate voltage value to the first gate voltage value at a third time after the second time, the first gate voltage value being effective for turning the thin film transistor off, the second gate voltage value being effective for turning the thin film transistor on; and changing the drain voltage from the first drain voltage value to a second drain voltage value at one of a fourth time and a fifth time, the fifth time being after the fourth time, the fourth time and the fifth time each being not before the second time and not after than the third time, the first drain voltage value and the second drain voltage value each being between the first gate voltage value and the second gate voltage value;

wherein the drain voltage is changed from the first drain voltage value to the second drain voltage value at the fourth time if a difference between the second gate voltage value and the second drain voltage value is less than a difference between the second gate voltage value and the first drain voltage value, and is changed from the first drain voltage value to the second drain voltage value at the fifth time if the difference between the second gate voltage value and the second drain voltage value is greater than the difference between the second gate voltage value and the first drain voltage value.

2. A method for driving a liquid crystal display device, the liquid crystal display device including a liquid crystal pixel, and a thin film transistor having a source, a drain, and a gate, the source of the thin film transistor being coupled to the liquid crystal pixel, the method comprising the steps of:

applying a drain voltage indicative of a video signal to the drain of the thin film transistor, the drain voltage having a first drain voltage value at a first time;

applying a gate voltage pulse to the gate of the thin film transistor, the gate voltage pulse being a gate voltage which changes from a first gate voltage value to one of a second gate voltage value and a third gate voltage value at a second time after the first time, and changes from the one of the second gate voltage value and the third gate voltage value to the first gate voltage value at a third time after the second time, the first gate voltage value being effective for turning the thin film transistor off, the second gate voltage value and the third gate voltage value each being effective for turning the thin film transistor on, the second gate voltage value being between the first gate voltage value and the third gate voltage value; and changing the drain voltage from the first drain voltage value to a second drain voltage value at a fourth time, the fourth time being not before the second time and not after than the third time, the first drain voltage value and the second drain voltage value each being between the first gate voltage value and the second gate voltage value;

wherein the gate voltage changes from the first gate voltage value to the second gate voltage value at the second time in a first frame and changes from the second gate voltage value to the first gate voltage value at the third time in the first frame if the second drain voltage value is closer to the first gate voltage value than is the first drain voltage value, and changes from the first gate voltage value to the third gate voltage value at the second time in a second frame and changes from the third gate voltage value to the first gate voltage value at the third time in the second frame if the second drain voltage value is further away from the first gate voltage value than is the first drain voltage value.

3. A method for driving a liquid crystal display device, the liquid crystal display device including a liquid crystal pixel, and a thin film transistor having a source, a drain, and a gate, the source of the thin film transistor being coupled to the liquid crystal pixel, the method comprising the steps of:

applying a drain voltage indicative of a video signal to the drain of the thin film transistor, the drain voltage having a first drain voltage value at a first time;

applying a gate voltage pulse to the gate of the thin film transistor, the gate voltage pulse being a gate voltage which changes from a first gate voltage value to a second gate voltage value at a second time after the first time, and changes from the second gate voltage value to the first gate voltage value at a third time after the second time, the first gate voltage value being effective for turning the thin film transistor off, the second gate voltage value being effective for turning the thin film transistor on; and changing the drain voltage from the first drain voltage value to a second drain voltage value at one of a fourth time and a fifth time, the fifth time being after the fourth time, the fourth time and the fifth time each being not before the second time and not after than the third time, one of the first drain voltage value and the second drain voltage value being between the first gate voltage value and a reference voltage value, another one of the first drain voltage value and the second drain voltage value being between the reference voltage value and the second gate voltage value, the reference voltage value being between the first gate voltage value and the second gate voltage value;

wherein the drain voltage is changed from the first drain voltage value to the second drain voltage value at the fourth time if the first drain voltage value is between the first gate voltage value and the reference voltage value and the second drain voltage value is between the reference voltage value and the second gate voltage value, and is changed from the first drain voltage value to the second drain voltage value at the fifth time if the first drain voltage value is between the reference voltage value and the second gate voltage value and the second drain voltage value is between the first gate voltage value and the reference voltage value.

4. A method according to claim 3 wherein the reference voltage value is halfway between a maximum voltage value the drain voltage can have and a minimum voltage value the drain voltage can have.

5. A method for driving a liquid crystal display device, the liquid crystal display device including a liquid crystal pixel, and a thin film transistor having a source, a drain, and a gate, the source of the thin film transistor being coupled to the liquid crystal pixel, the method comprising the steps of:

applying a drain voltage indicative of a video signal to the drain of the thin film transistor, the drain voltage having a first drain voltage value at a first time;

applying a gate voltage pulse to the gate of the thin film transistor, the gate voltage pulse being a gate voltage which changes from a first gate voltage value to one of a second gate voltage value and a third gate voltage value at a second time after the first time, and changes from the one of the second gate voltage value and the third gate voltage value to the first gate voltage value at a third time after the second time, the first gate voltage value being effective for turning the thin film transistor off, the second gate voltage value and the third gate voltage value each being effective for turning the thin film transistor on, the second gate voltage value being between the first gate voltage value and the third gate voltage value; and changing the drain voltage from the first drain voltage value to a second drain voltage value at a fourth time, the fourth time being not before the second time and not after than the third time, one of the first drain voltage value and the second drain voltage value being between the first gate voltage value and a reference voltage value, another one of the first drain voltage value and the second drain voltage value being between the reference voltage value and the second gate voltage value, the reference voltage value being between the first gate voltage value and the second gate voltage value;

wherein the gate voltage changes from the first gate voltage value to the second gate voltage value at the second time and changes from the second gate voltage value to the first gate voltage value at the third time if the first drain voltage value is between the reference voltage value and the second gate voltage value and the second drain voltage value is between the first gate voltage value and the reference voltage value, and changes from the first gate voltage value to the third gate voltage value at the second time and changes from the third gate voltage value to the first gate voltage value at the third time if the first drain voltage value is between the first gate voltage value and the reference voltage value and the second drain voltage value is between the reference voltage value and the second gate voltage value.

6. A liquid crystal display comprising:

a plurality of liquid crystal pixels arranged in rows and columns to form a matrix;

a plurality of thin film transistors, each of the transistors having a source, a drain, and a gate, the source of each of the thin film transistors being coupled to a respective one of the liquid crystal pixels;

drain driving means for applying a drain voltage indicative of a video signal to the drain of each of the thin film transistors, the drain voltage having a first drain voltage value at a first time; and gate driving means for applying a gate voltage pulse to the gate of each of the thin film transistors, the gate voltage pulse being a gate voltage which changes from a first gate voltage value to a second gate voltage value at a second time after the first time, and changes from the second gate voltage value to the first gate voltage value at a third time after the second time, the first gate voltage value being effective for turning the thin film transistors off, the second gate voltage value being effective for turning the thin film transistors on;

wherein the drain driving means changes the drain voltage from the first drain voltage value to a second drain voltage value at one of a fourth time and a fifth time, the fifth time being after the fourth time, the fourth time and the fifth time each being not before the second time and not after than the third time, the first drain voltage value and the second drain voltage value each being between the first gate voltage value and the second gate voltage value; and wherein the drain driving means changes the drain voltage from the first drain voltage value to the second drain voltage value at the fourth time if a difference between the second gate voltage value and the second drain voltage value is less than a difference between the second gate voltage value and the first drain voltage value, and changes the drain voltage from the first drain voltage value to the second drain voltage value at the fifth time if the difference between the second gate voltage value and the second drain voltage value is greater than the difference between the second gate voltage value and the first drain voltage value.

7. An information processing apparatus comprising:

a liquid crystal display;

wherein the liquid crystal display includes:

a plurality of liquid crystal pixels arranged in rows and columns to form a matrix;

a plurality of thin film transistors, each of the transistors having a source, a drain, and a gate, the source of each of the thin film transistors being coupled to a respective one of the liquid crystal pixels;

drain driving means for applying a drain voltage indicative of a video signal to the drain of each of the thin film transistors, the drain voltage having a first drain voltage value at a first time; and gate driving means for applying a gate voltage pulse to the gate of each of the thin film transistors, the gate voltage pulse being a gate voltage which changes from a first gate voltage value to a second gate voltage value at a second time after the first time, and changes from the second gate voltage value to the first gate voltage value at a third time after the second time, the first gate voltage value being effective for turning the thin film transistors off, the second gate voltage value being effective for turning the thin film transistors on;

wherein the drain driving means changes the drain voltage from the first drain voltage value to a second drain voltage value at one of a fourth time and a fifth time, the fifth time being after the fourth time, the fourth time and the fifth time each being not before the second time and not after than the third time, the first drain voltage value and the second drain voltage value each being between the first gate voltage value and the second gate voltage value; and wherein the drain driving means changes the drain voltage from the first drain voltage value to the second drain voltage value at the fourth time if a difference between the second gate voltage value and the second drain voltage value is less than a difference between the second gate voltage value and the first drain voltage value, and changes the drain voltage from the first drain voltage value to the second drain voltage value at the fifth time if the difference between the second gate voltage value and the second drain voltage value is greater than the difference between the second gate voltage value and the first drain voltage value.

8. A method for driving a liquid crystal display device, the liquid crystal display device including a liquid crystal pixel, and a thin film transistor having a source, a drain, and a gate, the source of the thin film transistor being coupled to the liquid crystal pixel, the method comprising the steps of:

applying a gate voltage pulse to the gate of the thin film transistor to turn the thin film transistor on for a period of time in each of a first frame and a second frame immediately following the first frame, the gate voltage pulse being a gate voltage which changes from a gate-off voltage value effective for turning the thin film transistor off to a gate-on voltage value effective for turning the thin film transistor on, remains at the gate-on voltage value for a predetermined pulse time, and then changes from the gate-on voltage value to the gate-off voltage value; and applying a drain voltage indicative of a video signal to the drain of the thin film transistor, the drain voltage changing to a first drain voltage value at a time during the gate voltage pulse in the first frame and remaining at the first drain voltage value until at least an end of the gate voltage pulse in the first frame such that the first drain voltage value overlaps the gate voltage pulse in the first frame for a first overlap time, and changing to a second drain voltage value at a time during the gate voltage pulse in the second frame and remaining at the second drain voltage value until at least an end of the gate voltage pulse in the second frame such that the second drain voltage value overlaps the gate voltage pulse in the second frame for a second overlap time;

wherein the second overlap time is greater than the first overlap time if a difference between the gate-on voltage value and the second drain voltage value is less than a difference between the gate-on voltage value and the first drain voltage value, and is less than the first overlap time if the difference between the gate-on voltage value and the second drain voltage value is greater than the difference between the gate-on voltage value and the first drain voltage value.

9. A method for driving a liquid crystal display device, the liquid crystal display device including a liquid crystal pixel, and a thin film transistor having a source, a drain, and a gate, the source of the thin film transistor being coupled to the liquid crystal pixel, the method comprising the steps of:

applying a gate voltage pulse to the gate of the thin film transistor to turn the thin film transistor on for a period of time in each of one frame and another frame immediately adjacent to the one frame, the gate voltage pulse being a gate voltage which changes from a gate-off voltage value effective for turning the thin film transistor off to a gate-on voltage value effective for turning the thin film transistor on, remains at the gate-on voltage value for a predetermined pulse time, and then changes from the gate-on voltage value to the gate-off voltage value, the gate-on voltage value in the other frame being different from the gate-on voltage value in the one frame; and applying a drain voltage indicative of a video signal to the drain of the thin film transistor, the drain voltage changing to a first drain voltage value at a time during the gate voltage pulse in the one frame and remaining at the first drain voltage value until at least an end of the gate voltage pulse in the one frame, and changing to a second drain voltage value at a time during the gate voltage pulse in the other frame and remaining at the second drain voltage value until at least an end of the gate voltage pulse in the other frame;

wherein the gate-on voltage value in the other frame is greater than the gate-on voltage value in the one frame if the second drain voltage value is greater than the first drain voltage value, or the gate-on voltage value in the one frame is less than the gate-on voltage value in the other frame if the first drain voltage value is less than the second drain voltage value.

10. A method according to claim 9 wherein the drain voltage changes to the first drain voltage value at a time during the gate voltage pulse in the one frame which is a predetermined period of time before the end of the gate voltage pulse in the one frame and remains at the first drain voltage value until at least the end of the gate voltage pulse in the one frame such that the first drain voltage value overlaps the gate voltage pulse in the one frame for a predetermined overlap time equal to the predetermined period of time, and changes to the second drain voltage value at a time during the gate voltage pulse in the other frame which is the predetermined period of time before the end of the gate voltage pulse in the other frame and remains at the second drain voltage value until at least the end of the gate voltage pulse in the other frame such that the second drain voltage value overlaps the gate voltage pulse in the other frame for the predetermined overlap time.

11. A method for driving a liquid crystal display device, the liquid crystal display device including a liquid crystal pixel, and a thin film transistor having a source, a drain, and a gate, the source of the thin film transistor being coupled to the liquid crystal pixel, the method comprising the steps of:

applying a gate voltage pulse to the gate of the thin film transistor to turn the thin film transistor on for a period of time in each of a first frame and a second frame immediately following the first frame, the gate voltage pulse being a gate voltage which changes from a gate-off voltage value effective for turning the thin film transistor off to a gate-on voltage value effective for turning the thin film transistor on, remains at the gate-on voltage value for a predetermined pulse time, and then changes from the gate-on voltage value to the gate-off voltage value; and applying a drain voltage indicative of a video signal to the drain of the thin film transistor, the drain voltage changing to a first drain voltage value at a time during the gate voltage pulse in the first frame and remaining at the first drain voltage value until at least an end of the gate voltage pulse in the first frame such that the first drain voltage value overlaps the gate voltage pulse in the first frame for a first overlap time, and changing to a second drain voltage value at a time during the gate voltage pulse in the second frame and remaining at the second drain voltage value until at least an end of the gate voltage pulse in the second frame such that the second drain voltage value overlaps the gate voltage pulse in the second frame for a second overlap time, one of the first drain voltage value and the second drain voltage value being between the gate-off voltage value and a reference voltage value, another one of the first drain voltage value and the second drain voltage value being between the reference voltage value and the gate-on voltage value, the reference voltage value being between the gate-off voltage value and the gate-on voltage value;

wherein the second overlap time is greater than the first overlap time if the first drain voltage value is between the gate-off voltage value and the reference voltage value and the second drain voltage value is between the reference voltage value and the gate-on voltage value, and is less than the first overlap time if the first drain voltage value is between the reference voltage value and the gate-on voltage value and the second drain voltage value is between the gate-off voltage value and the reference voltage value.

12. A method according to claim 11 wherein the reference voltage value is halfway between a maximum voltage value the drain voltage can have and a minimum voltage value the drain voltage can have.

13. A method for driving a liquid crystal display device, the liquid crystal display device including a liquid crystal pixel, and a thin film transistor having a source, a drain, and a gate, the source of the thin film transistor being coupled to the liquid crystal pixel, the method comprising the steps of:

applying a gate voltage pulse to the gate of the thin film transistor to turn the thin film transistor on for a period of time in each of one frame and another frame immediately adjacent to the one frame, the gate voltage pulse being a gate voltage which changes from a gate-off voltage value effective for turning the thin film transistor off to a gate-on voltage value effective for turning the thin film transistor on, remains at the gate-on voltage value for a predetermined pulse time, and then changes from the gate-on voltage value to the gate-off voltage value, the gate-on voltage value in the other frame being different from the gate-on voltage value in the one frame; and applying a drain voltage indicative of a video signal to the drain of the thin film transistor, the drain voltage changing to a first drain voltage value at a time during the gate voltage pulse in the one frame and remaining at the first drain voltage value until at least an end of the gate voltage pulse in the one frame, and changing to a second drain voltage value at a time during the gate voltage pulse in the other frame and remaining at the second drain voltage value until at least an end of the gate voltage pulse in the other frame, one of the first drain voltage value and the second drain voltage value being between the gate-off voltage value and a reference voltage value, another one of the first drain voltage value and the second drain voltage value being between the reference voltage value and the gate-on voltage value, the reference voltage value being between the gate-off voltage value and the gate-on voltage value;

wherein the gate-on voltage value in the other frame is greater than the gate-on voltage value in the one frame if the first drain voltage value is between the gate-off voltage value and the reference voltage value and the second drain voltage value is between the reference voltage value and the gate-on voltage value, or the gate-on voltage value in the one frame is less than the gate-on voltage value in the other frame if the second drain voltage value is between the reference voltage value and the gate-on voltage value and the first drain voltage value is between the gate-off voltage value and the reference voltage value.

14. A liquid crystal display comprising:

a plurality of liquid crystal pixels arranged in rows and columns to form a matrix;

a plurality of thin film transistors, each of the transistors having a source, a drain, and a gate, the source of each of the thin film transistors being coupled to a respective one of the liquid crystal pixels;

gate driving means for applying a gate voltage pulse to the gate of each of the thin film transistors to turn the thin film transistors on for a period of time in each of a first frame and a second frame immediately following the first frame, the gate voltage pulse being a gate voltage which changes from a gate-off voltage value effective for turning the thin film transistors off to a gate-on voltage value effective for turning the thin film transistors on, remains at the gate-on voltage value for a predetermined pulse time, and then changes from the gate-on voltage value to the gate-off voltage value; and drain driving means for applying a drain voltage indicative of a video signal to the drain of each of the thin film transistors, the drain voltage changing to a first drain voltage value at a time during the gate voltage pulse in the first frame and remaining at the first drain voltage value until at least an end of the gate voltage pulse in the first frame such that the first drain voltage value overlaps the gate voltage pulse in the first frame for a first overlap time, and changing to a second drain voltage value at a time during the gate voltage pulse in the second frame and remaining at the second drain voltage value until at least an end of the gate voltage pulse in the second frame such that the second drain voltage value overlaps the gate voltage pulse in the second frame for a second overlap time;

wherein the second overlap time is greater than the first overlap time if a difference between the gate-on voltage value and the second drain voltage value is less than a difference between the gate-on voltage value and the first drain voltage value, and is less than the first overlap time if the difference between the gate-on voltage value and the second drain voltage value is greater than the difference between the gate-on voltage value and the first drain voltage value.

15. An information processing apparatus comprising:

a liquid crystal display;

wherein the liquid crystal display includes:

a plurality of liquid crystal pixels arranged in rows and columns to form a matrix;

a plurality of thin film transistors, each of the transistors having a source, a drain, and a gate, the source of each of the thin film transistors being coupled to a respective one of the liquid crystal pixels;

gate driving means for applying a gate voltage pulse to the gate of each of the thin film transistors to turn the thin film transistors on for a period of time in each of a first frame and a second frame immediately following the first frame, the gate voltage pulse being a gate voltage which changes from a gate-off voltage value effective for turning the thin film transistors off to a gate-on voltage value effective for turning the thin film transistors on, remains at the gate-on voltage value for a predetermined pulse time, and then changes from the gate-on voltage value to the gate-off voltage value; and drain driving means for applying a drain voltage indicative of a video signal to the drain of each of the thin film transistors, the drain voltage changing to a first drain voltage value at a time during the gate voltage pulse in the first frame and remaining at the first drain voltage value until at least an end of the gate voltage pulse in the first frame such that the first drain voltage value overlaps the gate voltage pulse in the first frame for a first overlap time, and changing to a second drain voltage value at a time during the gate voltage pulse in the second frame and remaining at the second drain voltage value until at least an end of the gate voltage pulse in the second frame such that the second drain voltage value overlaps the gate voltage pulse in the second frame for a second overlap time;

wherein the second overlap time is greater than the first overlap time if a difference between the gate-on voltage value and the second drain voltage value is less than a difference between the gate-on voltage value and the first drain voltage value, and is less than the first overlap time if the difference between the gate-on voltage value and the second drain voltage value is greater than the difference between the gate-on voltage value and the first drain voltage value.

* * * * *